US005090860A

United States Patent [19]

Matsuo et al.

[11] Patent Number: 5,090,860

[45] Date of Patent: Feb. 25, 1992

[54] SHEET BINDER

[75] Inventors: Kazuhiro Matsuo, Tokyo; Koichi Murakami, Kanagawa; Yoichi Tagawa; Kenichi Iizumi, both of Ibaraki, all of Japan

[73] Assignee: Canon Kabushiki Kaisha, Tokyo, Japan

[21] Appl. No.: 725,238

[22] Filed: Jun. 26, 1991

Related U.S. Application Data

[63] Continuation of Ser. No. 634,826, Jan. 2, 1991, abandoned, which is a continuation of Ser. No. 500,730, Mar. 28, 1990, abandoned.

[30] Foreign Application Priority Data

| | | | |
|---|---|---|---|
| Mar. 31, 1989 | [JP] | Japan | 1-81121 |
| Mar. 31, 1989 | [JP] | Japan | 1-81122 |
| Apr. 7, 1989 | [JP] | Japan | 1-89455 |
| Apr. 7, 1989 | [JP] | Japan | 1-89456 |
| Apr. 13, 1989 | [JP] | Japan | 1-94207 |
| May 8, 1989 | [JP] | Japan | 1-114532 |
| May 8, 1989 | [JP] | Japan | 1-114533 |
| May 30, 1989 | [JP] | Japan | 1-36844 |

[51] Int. Cl.[5] ..... B42L 5/10

[52] U.S. Cl. ..... 412/11; 412/16; 412/46

[58] Field of Search ..... 412/11, 12, 16, 40

[56] References Cited

U.S. PATENT DOCUMENTS

| | | | |
|---|---|---|---|
| 3,125,887 | 3/1964 | Bouvier et al. | 412/40 X |
| 4,320,547 | 3/1982 | Stolle et al. | 412/40 |
| 4,324,013 | 4/1982 | Wu | 412/16 |
| 4,607,993 | 8/1986 | Scharer | 412/40 |
| 4,613,266 | 9/1986 | Scharer | 412/40 |
| 4,645,399 | 2/1987 | Scharer | 412/16 |
| 4,872,796 | 10/1989 | Hsieh et al. | 412/16 |

FOREIGN PATENT DOCUMENTS

| | | | |
|---|---|---|---|
| 920508 | 3/1963 | United Kingdom . | |
| 1436870 | 5/1976 | United Kingdom | 412/40 |

*Primary Examiner*—Timothy V. Eley
*Assistant Examiner*—William Fridie, Jr.
*Attorney, Agent, or Firm*—Fitzpatrick, Cella, Harper & Scinto

[57] ABSTRACT

A sheet binding apparatus includes a supporting member for supporting a set of sheets; a punch for punching the set of sheets on the supporting member; a binder for supporting a ring member and for binding the sheets by penetrating the ring member through punched holes of the sheets punched by the punch; a detector for detecting a size of the ring member supported on the binder; a device for changing a punching condition by the punch in accordance with an output of the detector; and a conveyer for conveying the set of sheets punched by the punch to the ring member supported on the binder.

11 Claims, 28 Drawing Sheets

SHEET BINDER

This application is a continuation of application Ser. No. 07/634,826 filed Jan. 2, 1991, which is a continuation of application Ser. No. 07/500,730 filed Mar. 28, 1990, both abandoned.

FIELD OF THE INVENTION AND RELATED ART

The present invention relates to a sheet binder, and more particularly to a ring type sheet binder wherein sheets are punched and the punched sheets are automatically bound by a binding ring member.

In a conventional ring binder wherein punched sheet materials are bound by a binding ring made of plastic resin comprising a spine and a number of inwardly curved fingers, the sheet materials are punched by a punching means including dies and punches, and thereafter, the sheet materials are taken out of the punching means, and the punched sheet materials are bound at another place.

Since the punched sheet materials are taken out of the punching means, and they are bound at another position, the binding operation is time-consuming, and expertise is required to bind the sheet materials with the ring member.

More particularly, the operator has to adjust the punch position so that the sheet materials are punched at the position corresponding to the size of the binding member, and also, the operator has to adjust the degree of opening of the binding member to make the binding operation easier.

Therefore, expertise is required for the stabilized operation. Otherwise, the operating time becomes longer with the high possibility of erroneous operation.

SUMMARY OF THE INVENTION

Accordingly, it is a principal object of the present invention to provide a sheet binding apparatus that is easy to operate.

It is a further object of the present invention to provide a sheet binding apparatus wherein the punch position of the sheet materials and the degree of opening of the binding member are automatically determined in accordance with the size of the binding member, and therefore, the binding operation can be performed stably without the need for an expert.

According to an aspect of the present invention, there is provided a sheet binding apparatus, comprising punching means for punching sheet materials, binding means for binding the punched sheet materials with a binding member, conveying means for automatically conveying the sheet materials punched by said punching means to said binding means, said conveying means being interrelated with said binding means, detecting means for detecting a size of the binding member when it is set in the binding means, position regulating means for regulating the position of the punch by said punching means, means for opening degree regulating the means for regulating degree of opening of the binding member, and control means for controlling said punch position regulating means and the opening degree regulating means in response to an output of said detecting means.

According to this aspect of the present invention, the sheet materials are punched at the position corresponding to the size of the binding member, and the sheet materials are automatically inserted into the opening having the degree of opening corresponding to the size of the binding member, and then, the sheet materials are bound by the binding member. Therefore, the operations requiring expertise are automatically operated. Accordingly, the stabilized sheet material binding operation can be easily and quickly performed without the experience and skill of the operator.

These and other objects, features and advantages of the present invention will become more apparent upon consideration of the following description of the preferred embodiments of the present invention taken in conjunction with the accompanying drawings.

BRIEF DESCRIPTION OF THE DRAWINGS

FIG. 16(*b*) is a side view when the ring is opened.

DESCRIPTION OF THE PREFERRED EMBODIMENTS

Preferred embodiments of the present invention will be described in conjunction with the accompanying drawings.

Figure 1:
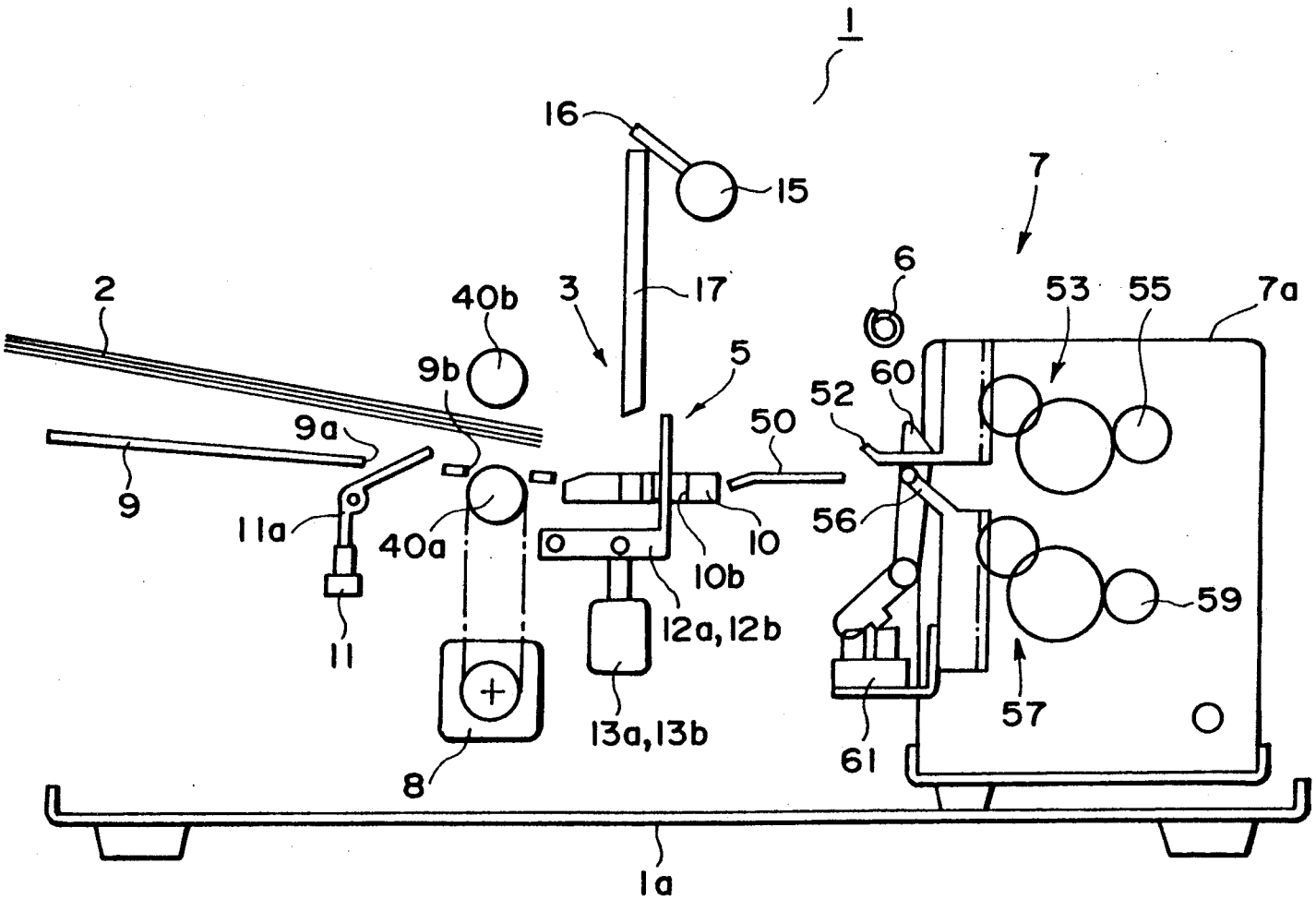
FIG. 1 is a sectional view of a binding apparatus according to an embodiment of the present invention.

Referring to FIG. 1, the sheet binding apparatus 1 according to the first embodiment comprises a punching station 3 for punching a set of sheet materials or sheets 2, a conveyer 5 for conveying the punched sheets 2 and a ring opening station 7 for opening and closing a binding ring 6 for binding the sheets 2 conveyed thereto. They are mounted on a bed 1*a* of the apparatus 1.

Figure 4:
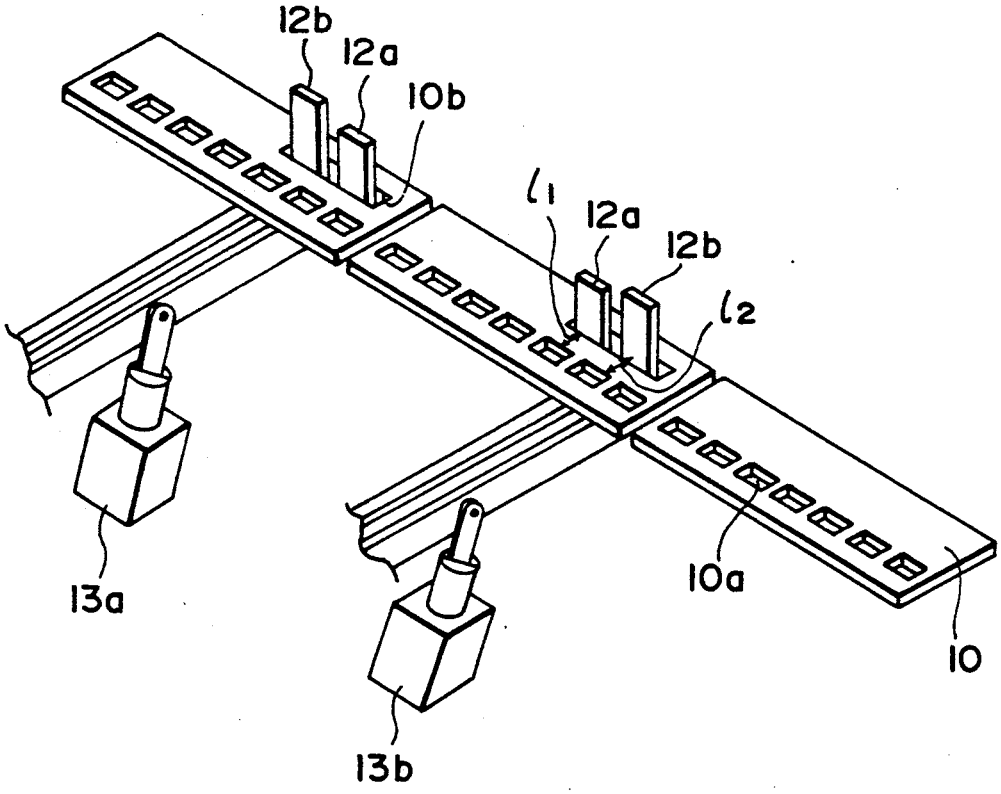
FIG. 4 is a perspective view of a die and a stopper.

Referring to FIGS. 1, 4, 5, 6, 7 and 8, the punching station 3 will be described. As shown in FIG. 1, a die 10 is disposed close to a sheet supporting tray 9. The supporting tray 9 is provided with a sensor hole 9*a* and a roller hole 9*b*. In the sensor hole 9*a*, a sensor lever 11*a* for detecting presence of the sheet material 2 is disposed. Below the sensor lever 11*a* a sensor 11 is disposed to detect the presence of the sheets 2 in response to the movement of the sensor lever 11*a*. As shown in FIG. 4, the die 10 has a number of square die holes 10*a* aligned in a line and two through holes 10*b* at a position downstream of the holes 10*a* with respect to the direction of the sheet conveyance which will be described hereinafter. Through the holes 10*b*, a pair of short stoppers 12*a* and a pair of long stoppers 12*b* for abutment with edges of the sheets 2 are retractable to align the sheets 2. The stoppers 12*a* constituting the pair are integrally connected, and also, the stoppers 12*b* constituting the pair are integrally connected. The stoppers 12*a* and 12*b* are coupled with solenoids 13*a* and 13*b*, respectively. The solenoids 13*a* and 13*b* lower the associated stoppers when it is deenergized, and raise them when it is energized. The distances $l_1$ and $l_2$ between the holes 12*a* and the stoppers 12*a* and 12*b* satisfy $l_1 < l_2$.

Figure 5:
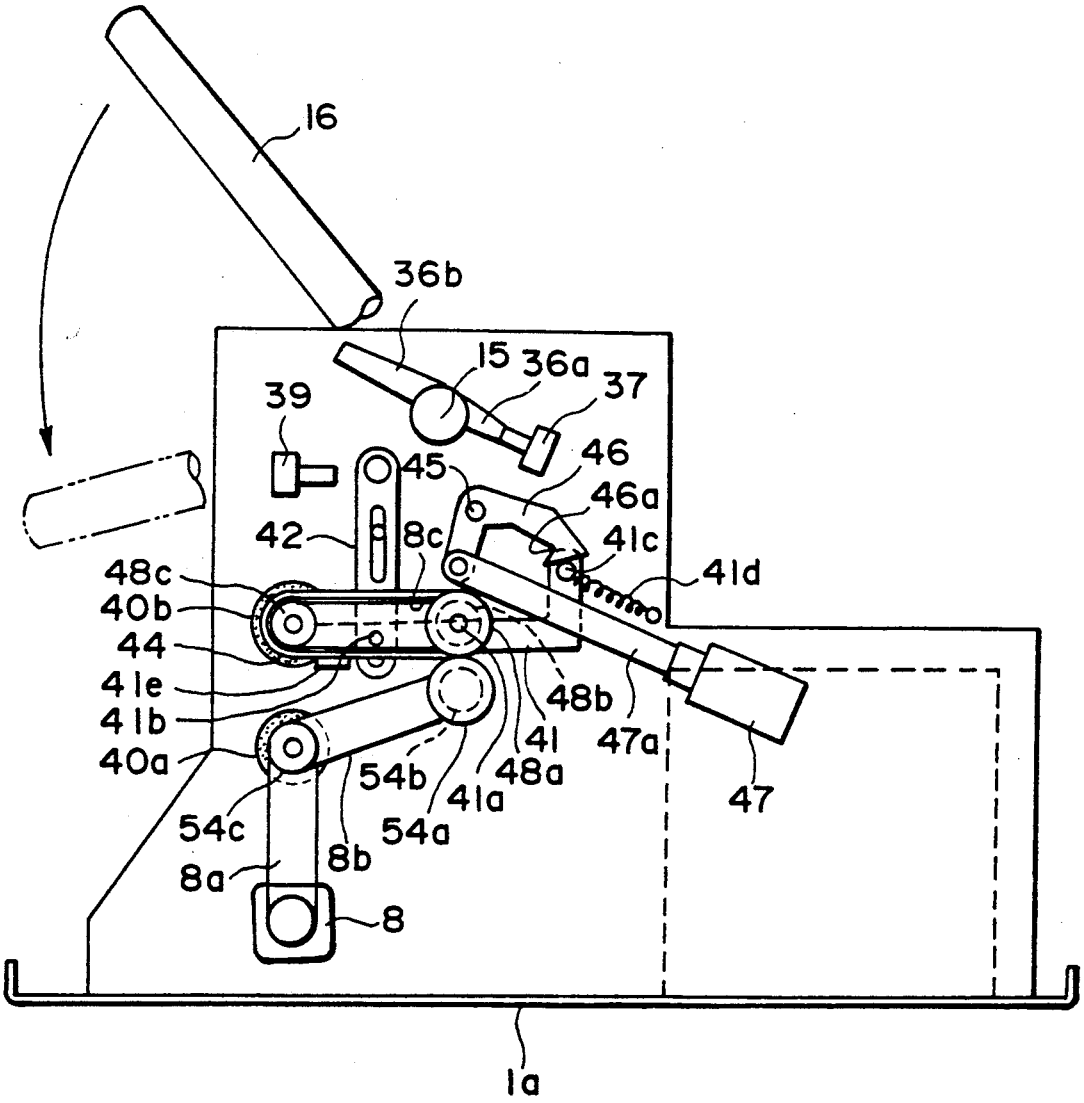
FIG. 5 is a side view of a punching station.
Figure 6:
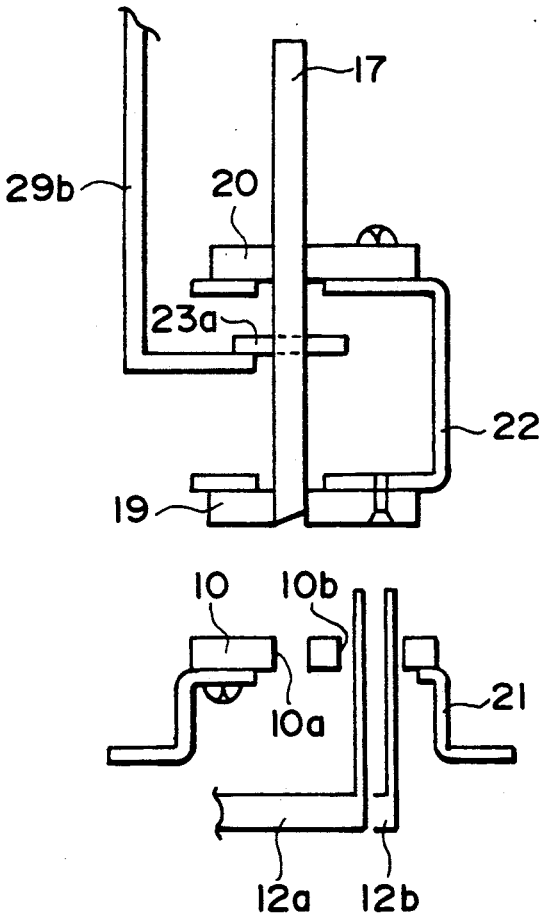
FIG. 6 is a enlarged side view illustrating a relation among the die, a puncher and a stopper.

As shown in FIGS. 1, 5 and 6, an operating lever 16 has a shaft 15. When it is rotated in the counterclockwise direction, the puncher 17 lowers along guides 19 and 20 to penetrate through the holes 10*a* of the die 10 which will be described hereinafter.

Figure 7:
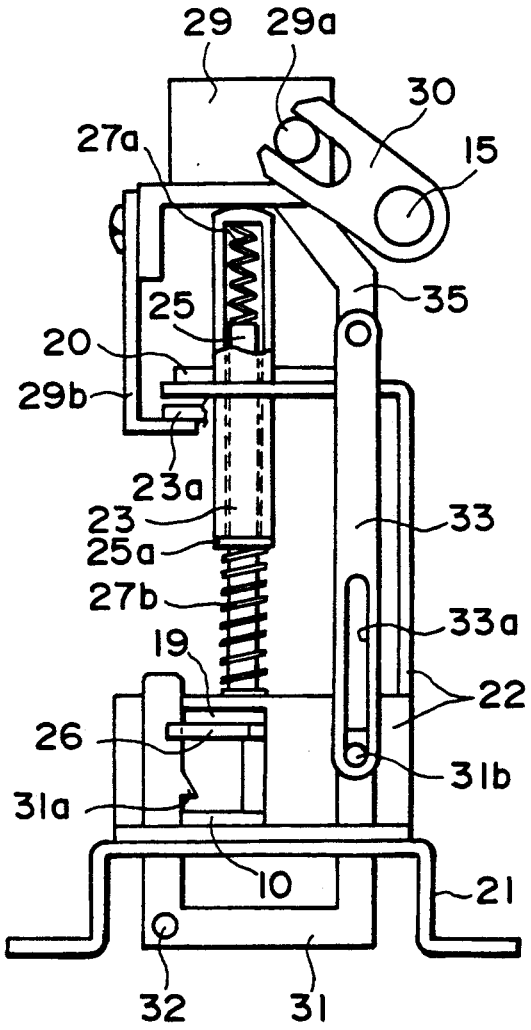
FIG. 7 is a side view of a sheet confining mechanism.
Figure 8:
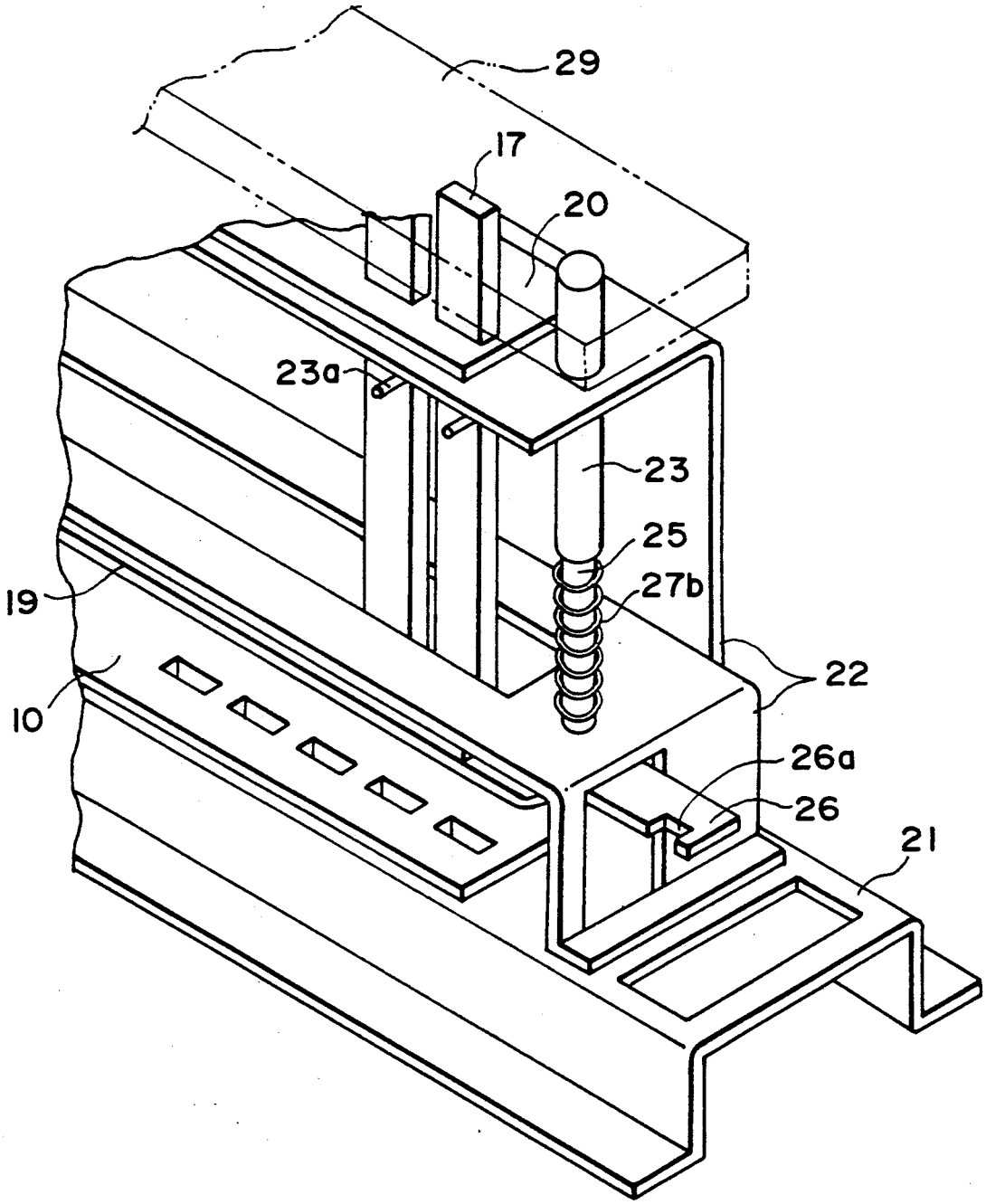
FIG. 8 is an enlarged perspective view of the sheet confining mechanism of FIG. 7.

As shown also in FIGS. 7 and 8, the die 10 is fixed on a die base 21. The guides 19 and 20 are fixedly mounted on a supporting frame 22 which is fixed to the die base 21. At upper portions adjacent longitudinally to opposite ends of the supporting frame 22, there are sleeves 23, and punching rods 25 in telescope relation therewith. The bottom of the pushing rods 25 are fixedly mounted to a confining plate 25. Between each of the sleeves 23 and an upper end of the associated pushing rod 25, a compression spring 27*a* is mounted, and between a flange 25*a* of each of the pushing rods 25 and the supporting frame 22, a compression coil spring 27*b* is mounted around the pushing rod 25. A pressing arm 29 is mounted on the top end of the punches 17, and it pushes the sleeve 23 downwardly. The pressing arm 29 is provided at longitudinal end projections 29*a* which are engaged with lever arms 30, which in turn is fixedly mounted to the ends of the shaft 15. When the lever 16 (FIGS. 1 and 5) is rotated in the clockwise direction, the pressing arm 29 lowers. Each of the punches 17 has a projection 23*a* which abuts a limiter 29*b* mounted on the pressing arm 29. The confining plate 26 has a cut-away portion 26*a* which engages with a locking plate 31 which has a generally hook shape. The locking plate 31 has a pawl 31*a* in its vertical portion. The bottom of the vertical portion is rotatably supported on a pin 32, and another vertical portion of the locking plate 31 has adjacent its upper end a projection 31*b* which is engaged with an elongated slot 33*a* of a releasing link 33. An upper portion of the releasing link 33 is rotatably supported on an arm 35 downwardly extended from the pressing arm 29, so that the pressing arm 26 is confined or released by the pawl 31*a* of the locking plate 31.

As shown in FIG. 5, sensor levers 36*a* and 36*b* are rotatable together with the lever 16. An upper sensor 37 and a lower sensor 39 face the sensor lever 36*a* when it is at its upper position, and face the sensor lever 36*b* when it is at its lower position, respectively.

Figure 9:
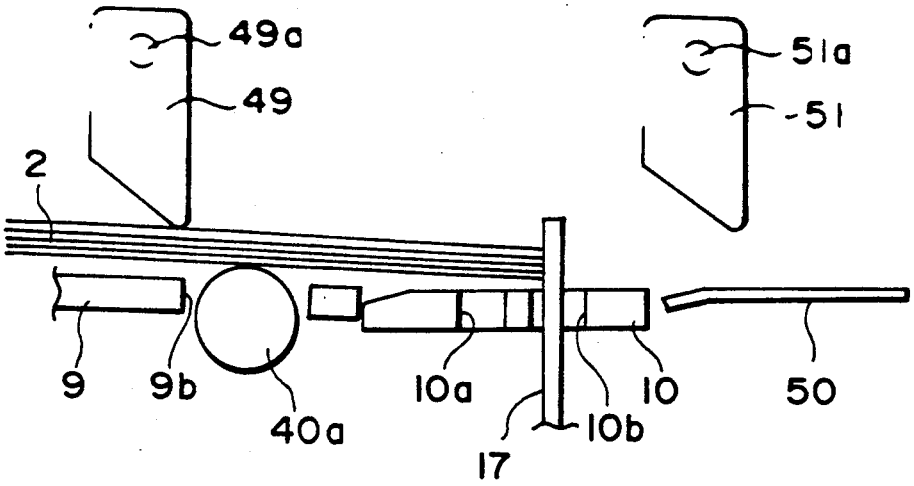
FIG. 9 is a side view of a conveyer.

Referring to FIGS. 1, 5 and 9, the conveyer 5 will be described. A conveying roller 40*a* which is driven by a motor 8 mounted rotatably on the apparatus 1 is projected through the roller hole 9*b* of the sheet supporting tray 9. A pick-up lever 41 is rotatably supported on a pin 41*a* fixedly mounted on the apparatus at its intermediate position. A lower end portion of the pick-up arm 42 is rotatably mounted on the lever 41 by a pin 41*b* at a left side of the pin 41*a*. A right end of a lever 44 is rotatably supported on the lever 41. To the left end of the lever 44, an upper conveying roller 40*b* is rotatably supported. On the right end of the lever 44, a gear 48*a* and a pulley 48*b* coaxially integral with the gear 48*a* are rotatably supported. A pulley 54*b* is coaxially integral with a gear 54*a* which is in meshing engagement with the gear 48*a*. A pulley 54*c* is coaxial with and integral with the lower conveying roller 41*a*. A pulley 48*c* is coaxial and integral with the upper conveying roller 41*b*. Belts 8*a*, 8*b* and 8*c* are trained around a pulley of the motor 8 and the pulley 54*c*, around the pulley 54*c* and the pulley 54*b*, around the pulley 48*b* and the pulley 48*c*, respectively. By the rotation of the motor 8 in the clockwise direction, the upper and lower conveying rollers 40*a* and 40*b* grip the sheet materials 2 and convey them rightwardly. A tension spring 41*d* is mounted to the lever 41, so that the lever 41 is normally urged in the clockwise direction about the pin 41*a*, and that the arm 42 is normally urged upwardly through the pin 41*b*. A vertical portion of the lever 41 is provided with a projection 41*c*, which is engageable with an engaging portion 46*a* of a hook 46 rotatably supported on a pin 45 fixed on the apparatus. The other end of the hook 46 is rotatably supported at an end of a core rod 47*a* of a solenoid 47. When the solenoid 47 is energized, the hook 46 rotates in the clockwise direction, by which the projection 41*c* is locked at its right side. When the solenoid 47 is deenergized, the hook 46 rotates in the counterclockwise direction to be released from the projection 41c. When the lever 16 is operated to rotate the sensor lever 36b in the counterclockwise direction to such an extent that the lower limit sensor 49 is interrupted, and when the arm 42 is lowered simultaneously against the upward urging force, the left side of the lever 41 is lowered, so that the lever 44 is released from the locking portion 41e of the lever 41, and the upper conveying roller 40b lowers by its weight together with the lever 44 to be press-contacted to the lower conveying roller 40a.

An inlet guide 49 (FIG. 9) for limiting the thickness of the set of sheet materials 2 is rotatably supported on a pin 49a fixed on the apparatus to be rotatable in the clockwise direction. A conveying tray 50 (FIG. 9) is disposed closely downstream of the die 10. A ring inlet guide 51 is effective to prevent disturbance of leading edges of the sheet materials 2 coming thereto. The guide 51 is rotatably supported on a pin 51a fixedly mounted on the apparatus.

Referring to FIG. 1, 10, 11, 12, 13 and 14, the ring opener 7 will be described. Upper pawls 52 are extended in a horizontal plane in the form of comb, and they have inclinedly bent up ends. The upper pawls 52 are vertically guided by the insides of the side walls of the main assembly 7a of the ring opener. The upper pawls 52 are driven by a motor 55 through a gear train 53. A number of lower pawls 56 are projected up inclinedly, and they have end portions extending perpendicularly to the conveyance direction of the sheet materials 2. The lower pawls 56 are driven by a motor 59 through a gear train 57. A ring 6 which is a binding member having one spine and a number of lateral fingers bent into substantial circles is set on the upper pawls 52 at its fingers. The sensor lever 60 rotatably mounted on a shaft 60a and normally urged in the clockwise direction, is rotated in the counterclockwise direction by the distance corresponding to an outside diameter of the ring 6. Below the sensor lever 60, a plurality of ring sensors 61 are disposed along a line to detect the presence of the ring 6 and the size of the ring 6.

Figure 13:
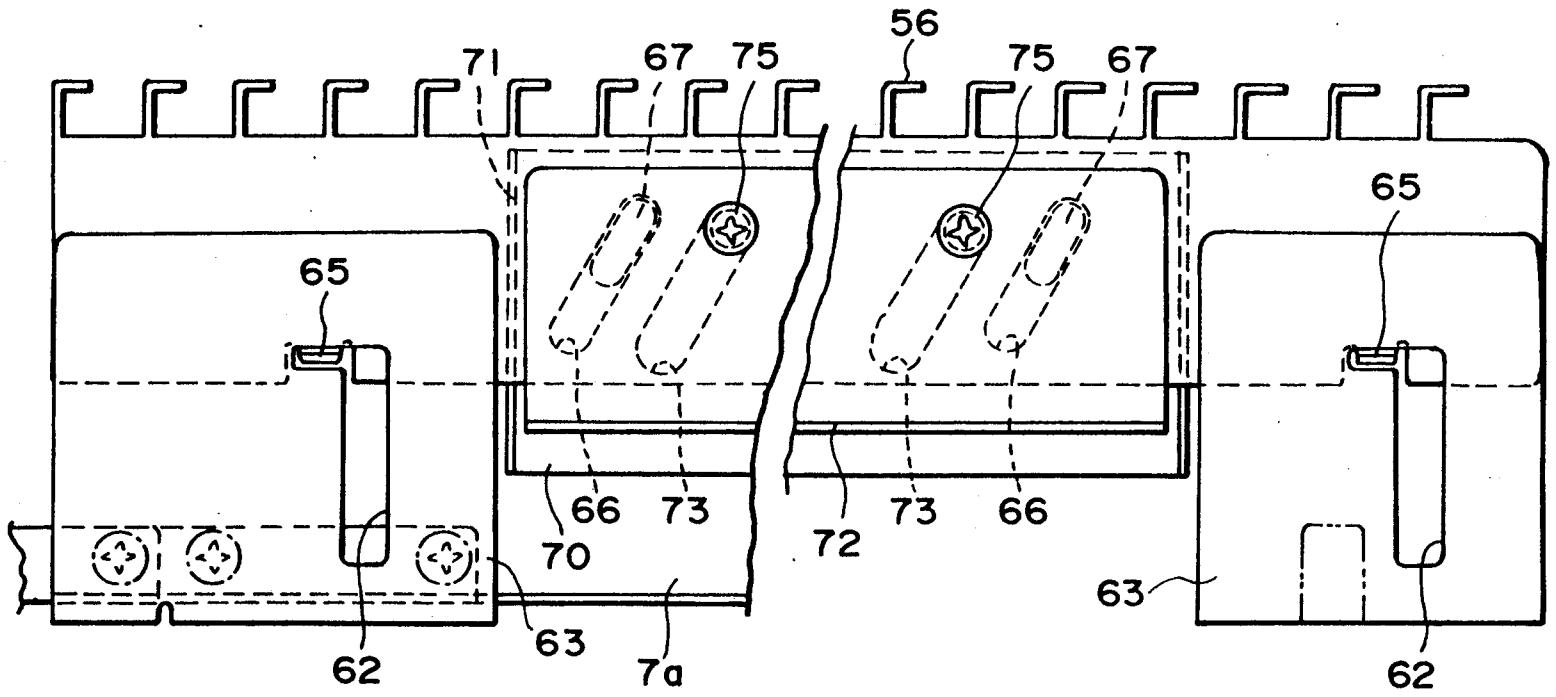
FIG. 13 is an enlarged front view illustrating a lower pawl operating mechanism.
Figure 14:
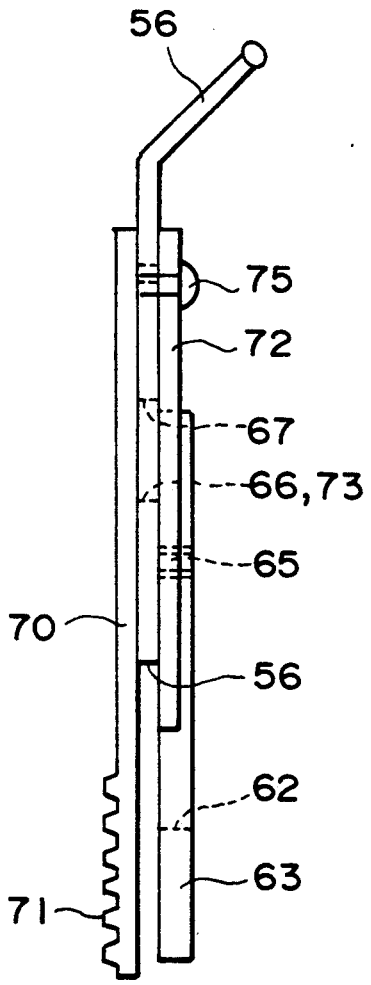
FIG. 14 is an enlarged view of the structure shown in FIG. 13.

Further referring to FIGS. 13 and 14, an operating mechanism for the lower pawl 56 will be described in detail. FIG. 13 shows a front view, and FIG. 14 shows a side view, of the operating mechanism. A guide plate 63 is provided with a groove 62 at insides of both sides of the lower pawls 56. The groove 62 has horizontal and vertical portions. The guide plate 63 is mounted on the ring opener main assembly 7a. Projections 65 of the plate having the lower pawls 56 are guided along the groove 62. At the middle of the lower pawls 56, a pair of slanted grooves 66 is formed. A slanted projection 67 slidingly guided by the slanted groove 66 is formed on a driving plate 70 which is vertically movable. The driving plate 70 is supported for vertical movement on the ring opener main assembly 7a. The driving plate 70 is provided with a rack 71 which is in meshing engagement with an end gear of the gear train 57. At the front side of the lower pawls 56, a confining plate 72 is provided, and the confining plate 72 and the driving plate 70 are fixed by screws 75 penetrating a slanted loose groove 73 of the member having the lower pawls 56.

Figure 2A:
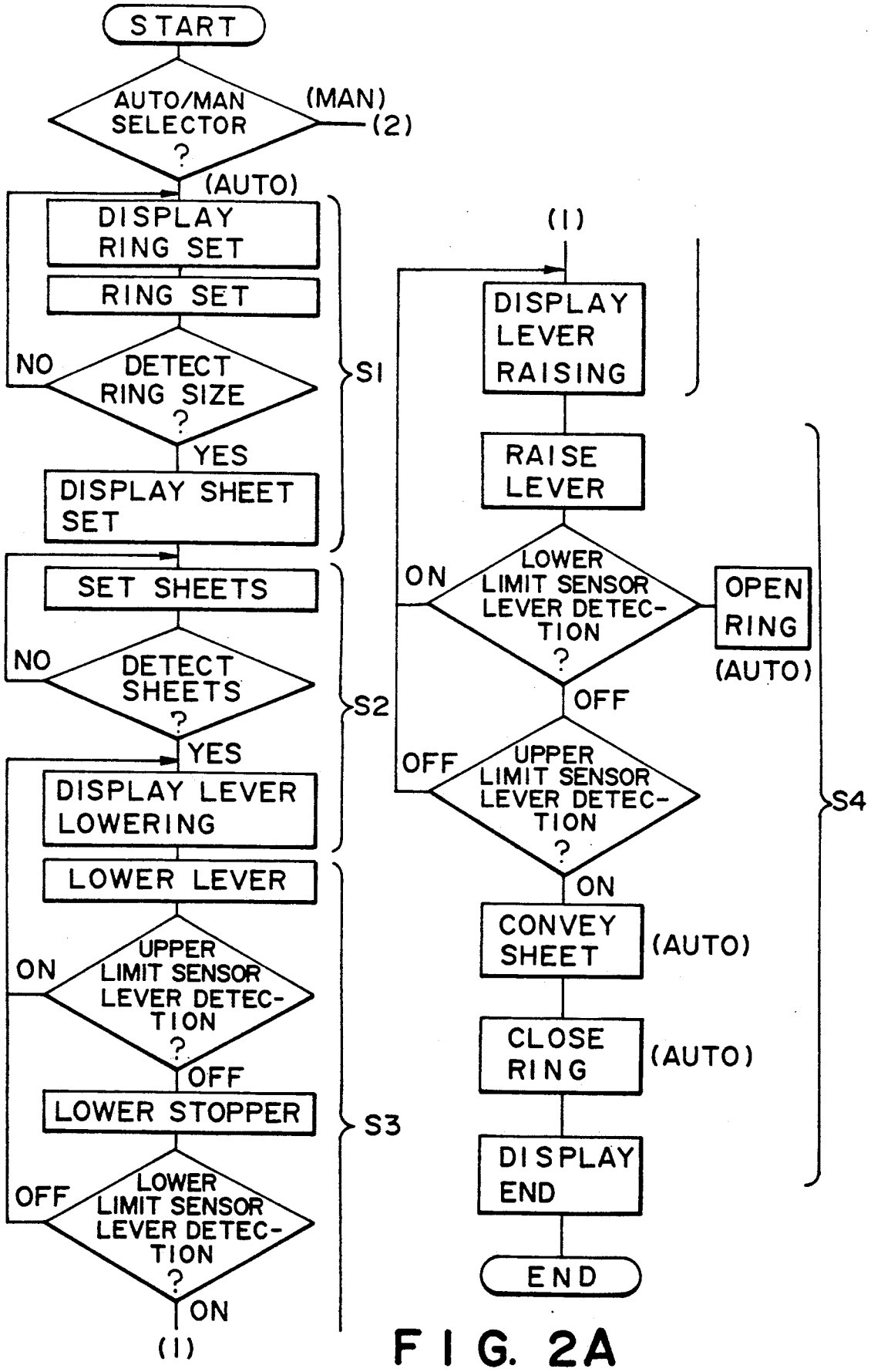
FIGS. 2A and 2B are flow charts illustrating operations of the apparatus.
Figure 3:
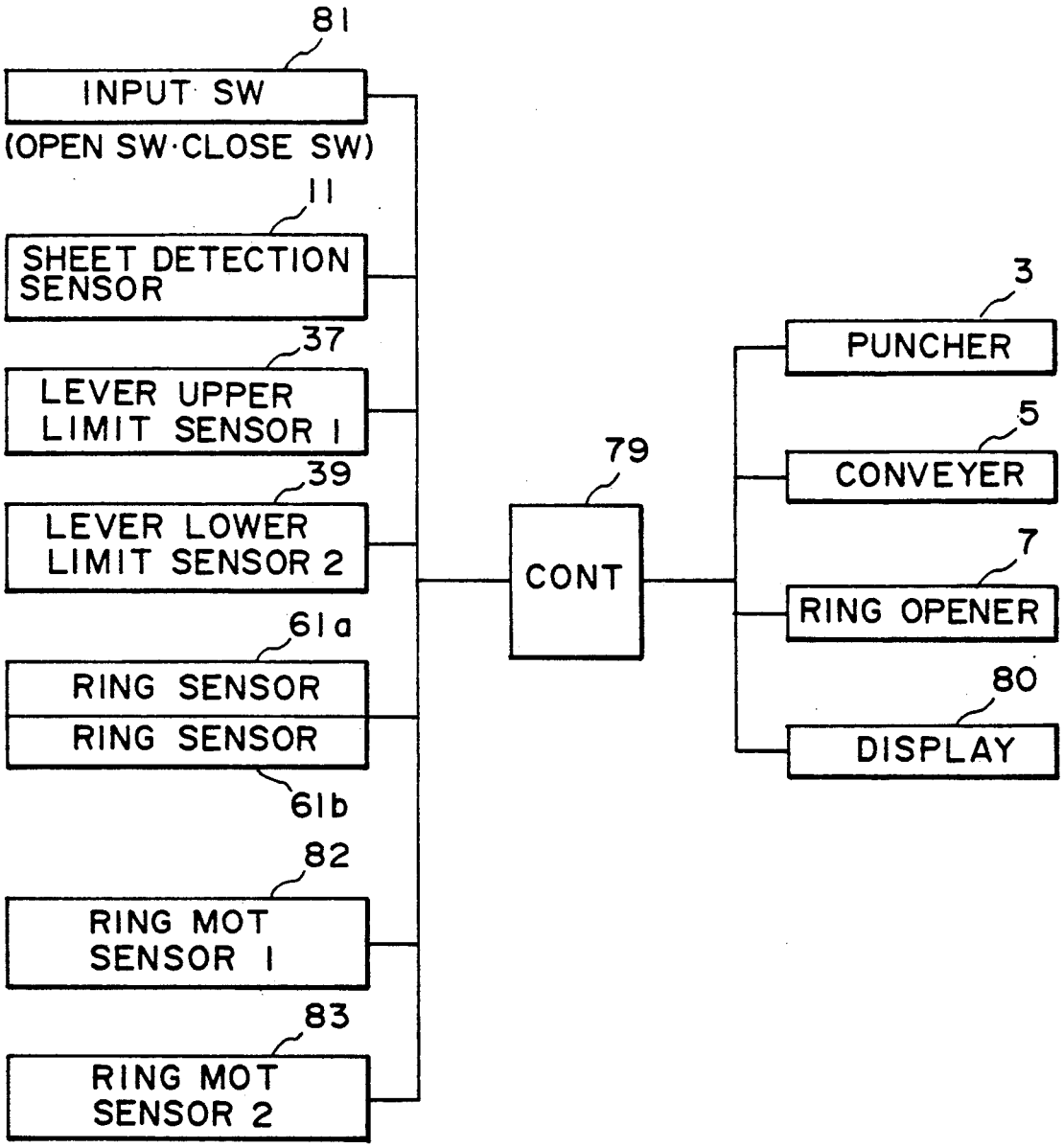
FIG. 3 is a block diagram illustrating a control system of the apparatus.

Referring to FIGS. 2A and 3, the operation of the apparatus constructed in the manner described above will be described. In FIG. 2A, an automatic mode is selected, and a switch 81 is actuated. When the fingers of the ring 6 are set on the upper pawls 52, the sensor lever 60 rotates in the counterclockwise direction about the shaft 60a. In response thereto, the controller 79 receives from the sensors 61a and 61b a signal representing a size of the ring 6 and a signal representing the presence of the ring 6. The controller 79 transmits a signal to a display 80 to display a message that the sheets are to be set (S1).

At this time, the controller 79 selectively actuates the solenoid 13a or 13b, in accordance with the size of the ring 6 detected so as to project the stopper 12a or 12b through the hole 10b of the die 10. Then, the sheets are inserted until they are stopped by the stopper 12a or 12b. Then, the controller 79 receives a signal from the sensor 11, and a message is displayed on the display 80 that the lever is to be lowered (S2). Then, the operator lowers the lever 16. When the upper limit sensor 37 is deactuated by the disappearing of the sensor lever 36a, a signal indicative of that event is transmitted to the controller 79. Then, the elevated one of the solenoids 13a and 13b is lowered to lower the stopper 12a or 12b. Simultaneously, the pushing arm 29 is lowered by the lever arm 30, by which the sleeve 23 lowers against the spring forces by the compression springs 27a and 27b, by which the confining plate 26 integral with the pushing rods 25 presses the set of sheet materials 2. The lowered confining plate 26 is locked by the pawls 31a of the locking plate 31. Simultaneously, the punches 17 are lowered to punch the set of sheet materials on the die 10. Simultaneously, the pick-up arm 42 is lowered by the sensor lever 36b against the upward urging force. Then, the pick-up lever 41 lowers, and the upper conveying roller 40b and the lever 44 presses downwardly the set of sheet materials 2 by the weight thereof. Simultaneously, the controller 79 receiving a signal from the lower limit sensor 39 now actuated deenergizes the solenoid 47, upon which the lever 41 is locked through the core rod 47a, a locking portion 46a of the hook 46 and the projection 41c, and also a message indicative that the lever is to be raised is displayed on the display 80 (S3).

In this case if the bottom surface of the confining plate 26 is pressed to the set of sheet materials 2 before the punching edges of the punches 17 reach the set of sheet materials 2, the sheet materials 2 are confined before the start of the punching action, so that the possible disturbance (misalignment) of the sheet materials 2 can be prevented. This can be accomplished by adjusting the compression springs 27a and 27b. Even if the confining plate 26 is pressed to the sheet materials 2 earlier, excessive compression force to the pushing rods and the sleeves 23 can be avoided by the provision of the compression springs 27a and 27b.

When the lever 16 is raised to such an extent that the sensor lever 36b deactuates the lower limit sensor 39, the controller 79 receives a signal indicative of this event, upon which the controller 79 opens the ring 6. On the other hand, when the sensor lever 36a actuates the upper limit sensor 37, the punches 17 have been retracted by the lever 16 through the pressing arm 29. With a delay from completion of the retraction of the punches 17 from the sheet materials 2, the locking plate is rotated by the upward movement of the pressing arm 29, in the counterclockwise direction about the pin 32 through the arm 35 and the releasing link 33, upon which the confining plate 26 is released from the pawl 31a, upon which the confining plate 26 is moved away from the sheet materials 2.

Figure 12:
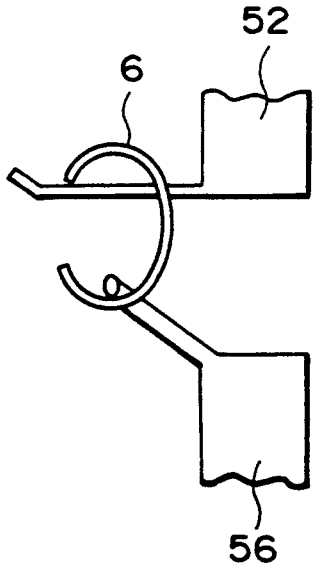
FIG. 12 is a side view wherein the binding member is opened.

The controller 79 receiving the actuation of the upper limit sensor 37 produces signals for actuating the stepping motor 8 for driving the conveying rollers 40*a* and 40*b*. The sheet materials are conveyed to the ring opener 7 by the conveying rollers 40*a* and 40*b* through a distance corresponding to a predetermined number of pulses. During the movement, the leading edges of the sheet materials 2 are prevented from being disturbed, by the inlet guide 51. The set of sheet materials is stopped at a proper position relative to the ring 6 which is opened as shown in FIG. 12, and thereafter, the ring 6 is closed.

The controller 79 receiving a signal representative of the stepping motor 8 stop produces a signal for deenergizing the solenoid 47, upon which the projection 41*c* is disengaged from the engaging portion 46*a*, and the upper conveying roller 40*b* is raised by the urging force by the tension spring 41*d* through the engaging portion 41*e* of the lever 41 and through the lever 44. After the ring 6 is closed, the display indicative of the completion of the binding operation is made on the display 80. This is the end of the binding operation (S4). After the completion, the operator pulls the bound sheet materials 2 in the direction opposite to the setting direction. At this time, the ring inlet guide 51 and the inlet guide 49 (FIG. 9) rotate in the clockwise direction so as not to impede the pulling action.

Referring to FIGS. 13 and 14, the operation of the lower pawls 56 will be described. The rack 71 is lowered by the motor 59 through the gear train 57 shown in FIG. 1. Then, the driving plate 69 lowers along the guiding plate 70. The slanted projection 67 of the guiding plate 70 applies a rightward force component to the lower pawls 56 through the slanted groove 66 in FIG. 13. By this the projections 65 of the lower pawl 56 assembly are guided along the horizontal portions of the groove 62 of the guiding plate 63 to be moved rightwardly, by which the lower pawls 56 become engageable with the fingers of the ring 6. Subsequently, they are guided by the vertical portions of the groove 62 by the downward component force, by which the lower pawls 56 lower to open the fingers of the ring 6 downwardly. When the rack 71 is pressed upwardly by the motor 59, the lower pawls 56 move downwardly. The confining plate 78 is integral with the driving plate 69 by the screws 75 to always retain the lower pawls. Therefore, the screws 75 make the same movement as the slanted projection 67. In consideration of this, a slanted loose hole 73 similarly to the slanted groove 66 is formed in the lower pawl 56 assembly.

In the foregoing embodiment, the bound sheet materials 2 are manually pulled out in the direction opposite to the sheet setting and conveyance direction. However, the bound sheet materials 2 may be automatically retracted by reversely rotating the motor 8 for driving the conveying rollers 40*a* and 40*b* when the completion of the binding operation is displayed on the display 80 without deenergizing the solenoid 47. By doing so, the labor for the binding operation can be saved, and the working period can be saved, too.

Referring to FIG. 1, 2B, 15 and 16, the manual mode will be described. At the bottom right side of the main assembly 7*a* of the ring opener, pins 76 are provided to rotatably support the main assembly 7*a* on the bed 1*a*, and a microswitch 77 is provided which produces a signal when the main assembly 7*a* is inclined and then fixed. The apparatus is provided with a ring opening button and a ring closing button. The inclining and fixing mechanism for the main assembly 7*a* may be in a rail-stopper type or a magnet attraction type.

Figure 2B:
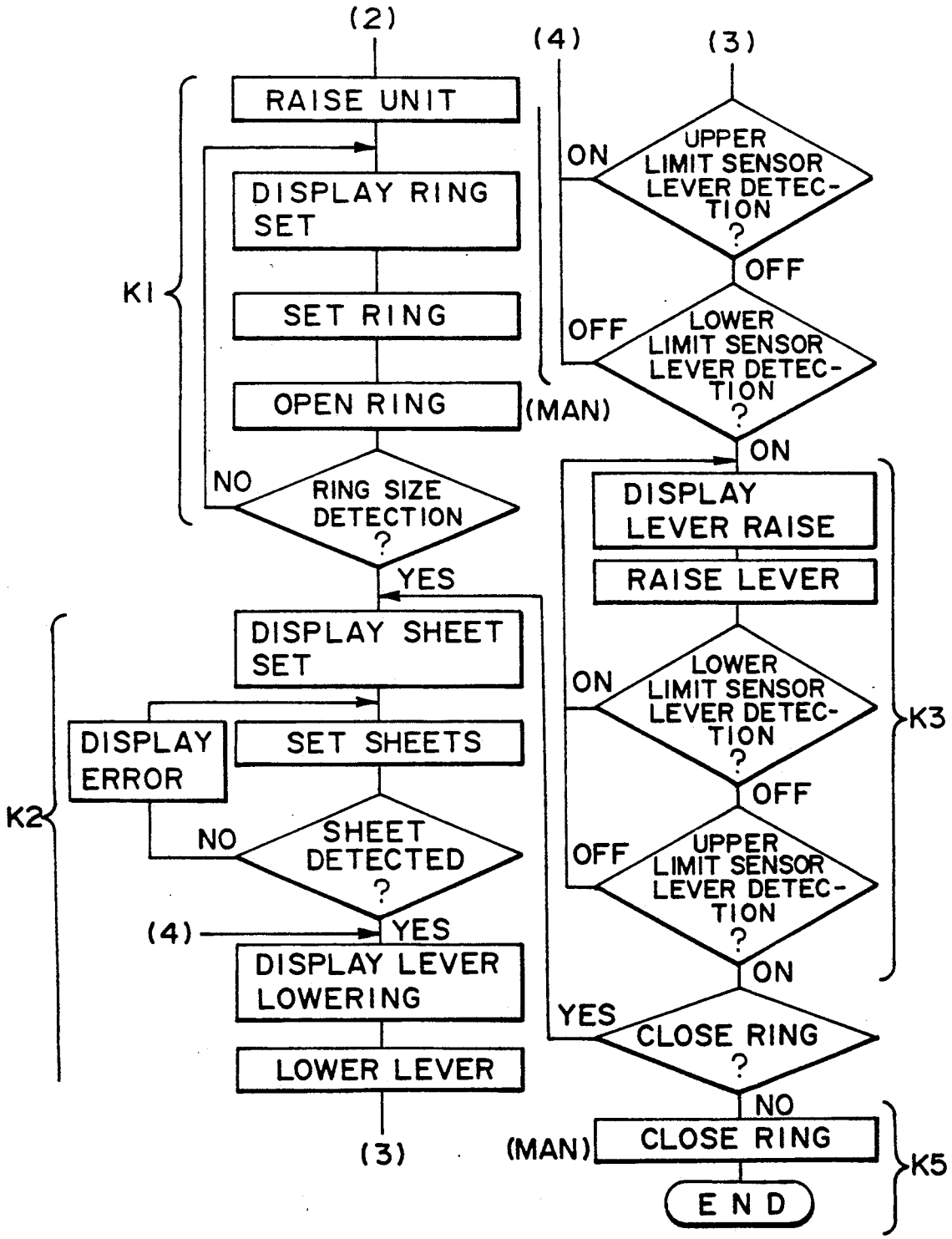

Referring to FIG. 2B, the operation of the apparatus in the manual mode will be described.

Figure 15:
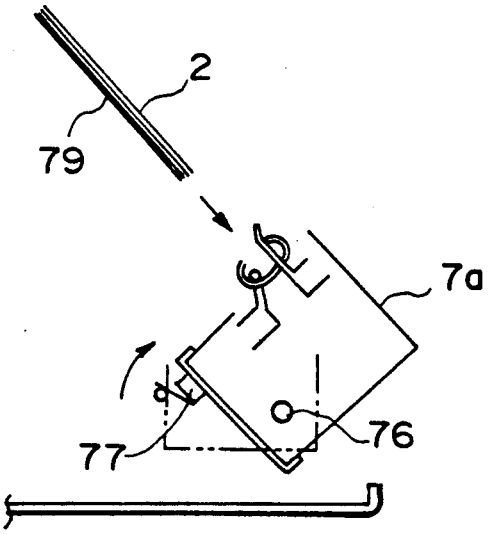
FIG. 15 is a side view in a manual mode.
Figures 16A, 16B:
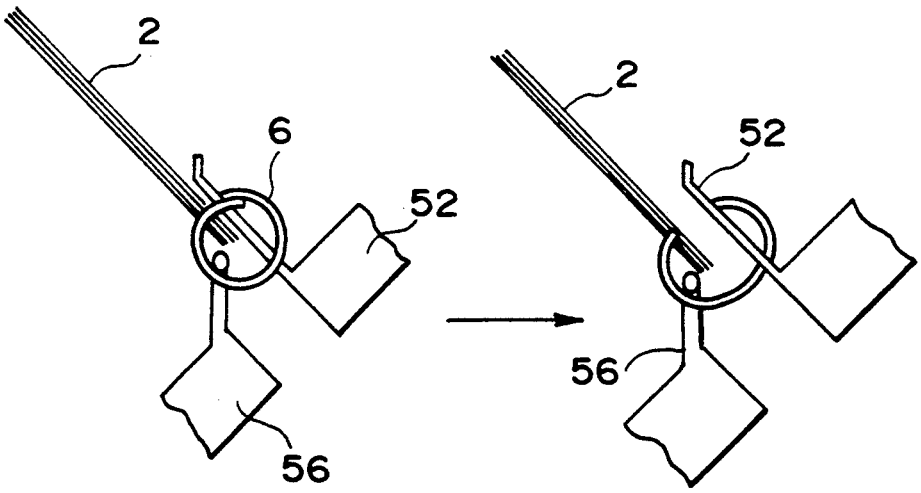
FIG. 16(*a*) is a side view wherein a ring is set on an upper pawl.

As shown in FIG. 15, when the main assembly 7*a* is inclined and fixed, the manual mode shown in FIG. 2(*a*) is selected, and the microswitch 77 is actuated to produce a signal. Receiving the signal, the controller 79 switches the control system to a manual mode shown in FIG. 2(*b*)(2). The step K1 is effected by actuating the ring opening button. Then, either one of the stoppers 12*a* and 12*b* is raised in accordance with the size of the ring 6. In step K2, together with the lowering of the lever 16, the confining plate 26 is pressed to the set of the sheet materials 2. The confining plate 26 is locked in response to the detection of the lever by the lower limit sensor 39, and the confining plate 26 is released upon the detection of the lever by the upper limit sensor 37. However, the conveying rollers 40*a* and 40*b* do not rotate. The ring is opened manually at step K1, but may be opened at the end of step K3. The punched set of sheet materials 2 is inserted to the opened ring 6 shown in FIG. 16B. When the insertion is completed, the ring is maintained opened. When additional sheet material or sheet materials 2 are to be bound together, the steps K4, K2 and K3 are executed. At step K5, the ring closing button is actuated to close the ring 6, as shown in FIG. 16(*a*). This is the end of the operation.

When the bound sheet material or sheet materials 6 are to be exchanged, the ring opening button is actuated at step K1, and all or part of the bound sheet materials 2 are exchanged, and the similar steps are executed.

The reason why the main assembly 7*a* is inclined and fixed is that by doing so, the operativity during the adding and exchanging operations are improved. When the inclined main assembly 7*a* is returned to the original position, the automatic mode is established.

An apparatus according to a second embodiment will be described which has similar structure as described in FIGS. 1–16, but which includes control means for preventing the binding member from opening beyond the maximum degree.

Figure 17:
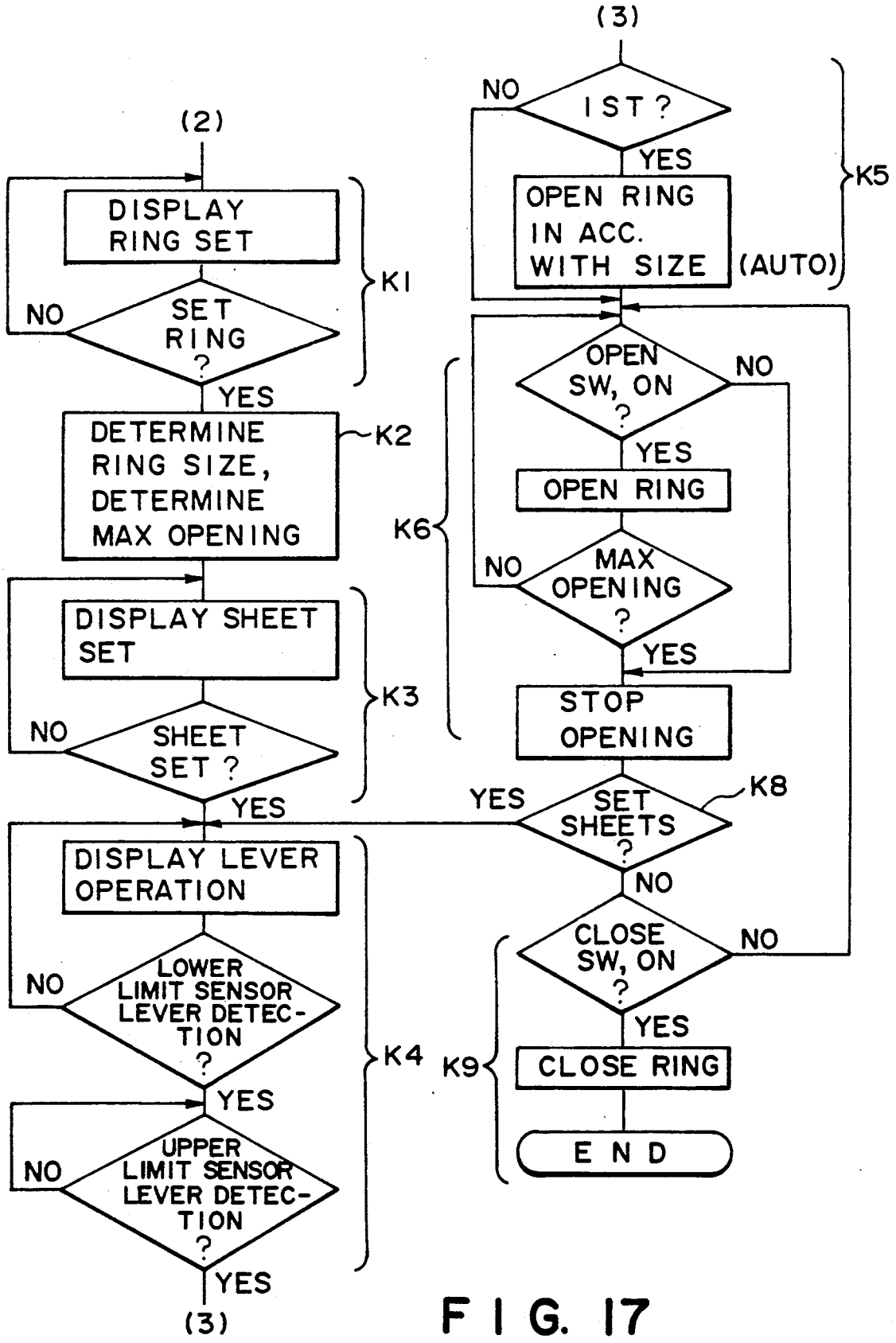
FIG. 17 is a flow chart illustrating the operation in a manual mode of the apparatus according to a second embodiment of the present invention.

Referring to FIGS. 17, 15 and 16, the manual mode will first be described, wherein the apparatus 1 is manually operated. As shown in FIG. 15, the main assembly 7*a* of the ring opener 7 is inclined and fixed, by which the manual mode of FIG. 2A is selected, and an actuation signal of the microswitch 77 is produced. The controller 79 receiving the signal switches its control system to the manual mode (2) shown in FIG. 17B. At step K1, the promotion of the ring set is displayed. When the ring 6 is set, and it is discriminated, step K2 is executed to detect the size of the ring 6. The maximum degree of the opening of the ring (the degree of opening not exceeding the elasticity limit of the ring) is stored in the controller 79 for each of the sizes of the rings. The controller 79 transmits a signal indicative of the maximum opening degree for the detected size of the ring to the drivers for the motors 55 and 59, and compares them with the signals from the ring motor sensors 82 and 83, and thereafter, the maximum opening degree is determined.

Alternatively, the maximum degree of opening may be determined by using a stepping motor and counting the number of output driving pulses or by using a motor with an encoder producing an output of the pulses proportional to the rotational number of the motor.

Then, step K3 is performed in which the promotion of sheet material setting is displayed. The detection is made as to whether or not the sheet materials 2 are set. After the sheet materials 2 are set, step K4 is executed in which the request for the lever 16 operation is displayed to punch the sheet materials. When the operation of the lever 16 is confirmed by the lower and upper limit sensors 39 and 37, step K7 is performed in which the ring 6 is opened automatically in accordance with the size of the ring 6. The automatic opening occurs in the first opening operation. In the subsequent opening operations, the step K5 is omitted, and step K6 is executed. At the step K6, the ring opening button 86 (FIG. 3) is depressed to open the ring 6 to the maximum degree determined by the step K2. The controller 79 prevents the ring 6 from being opened beyond the maximum degree, so that the motors 55 and 59 are stopped when the maximum degree is reached.

If, at step K8, the sheet materials 2 are to be punched for the second or subsequent operation, the steps K4 and K6 are repeated. If the sheet materials 2 are not set at step K8, the step K9 is operated in which the ring 6 is closed by an unshown ring closing button. This is the end of the binding operation.

As described in the foregoing, since the ring 8 is opened automatically to the maximum degree, the proper binding operation is assured irrespective of the degree of expertise of the operator and without improper closing of the ring 6, so that the operating efficiency is increased.

The punched sheet materials 2 may be bound once all together, or little by little. In addition, when the sheet materials are to be added to the bound sheet materials, or all or part of the bound sheet materials to be exchanged, the operations will be performed with the ring 6 opened in the state shown in FIG. 16(*b*). Since the main assembly 7*a* of the ring opener 7 is inclined and fixed, it is easy to watch and operate the apparatus.

A modification will be described. In the above embodiment, if only one maximum opening degree is set in accordance with a size of the ring 6, it is very effective for standard material which is most frequency used. However, depending on the materials of the ring 6, the ring has higher or lower elasticity limit, that is, the maximum opening degree is small or large, although the sizes are the same. In order to meet this, as shown in FIG. 18, a maximum opening degree changing button 85 is provided, by which the maximum opening degree is determined by the controller 79 in accordance with the signal from the ring sensor 61.

The maximum opening degree changing button 85 may be such that the maximum degree can be stepwisely changed depending on the number of depressing actions or depending on the time period in which it is depressed, as in a dip switch, or may be such that the degree can be continuously changed using a variable resistor. The ring opening button 86 and the maximum opening degree changing button 85 may be made integral, and the opening degree of the ring 6 is determined by the depressing period and the number of depressing actions of the button.

By doing so, the opening degree can be easily adjusted manually, so that the binding operation latitude of the sheet materials 2 can be easily expanded.

Figure 18:
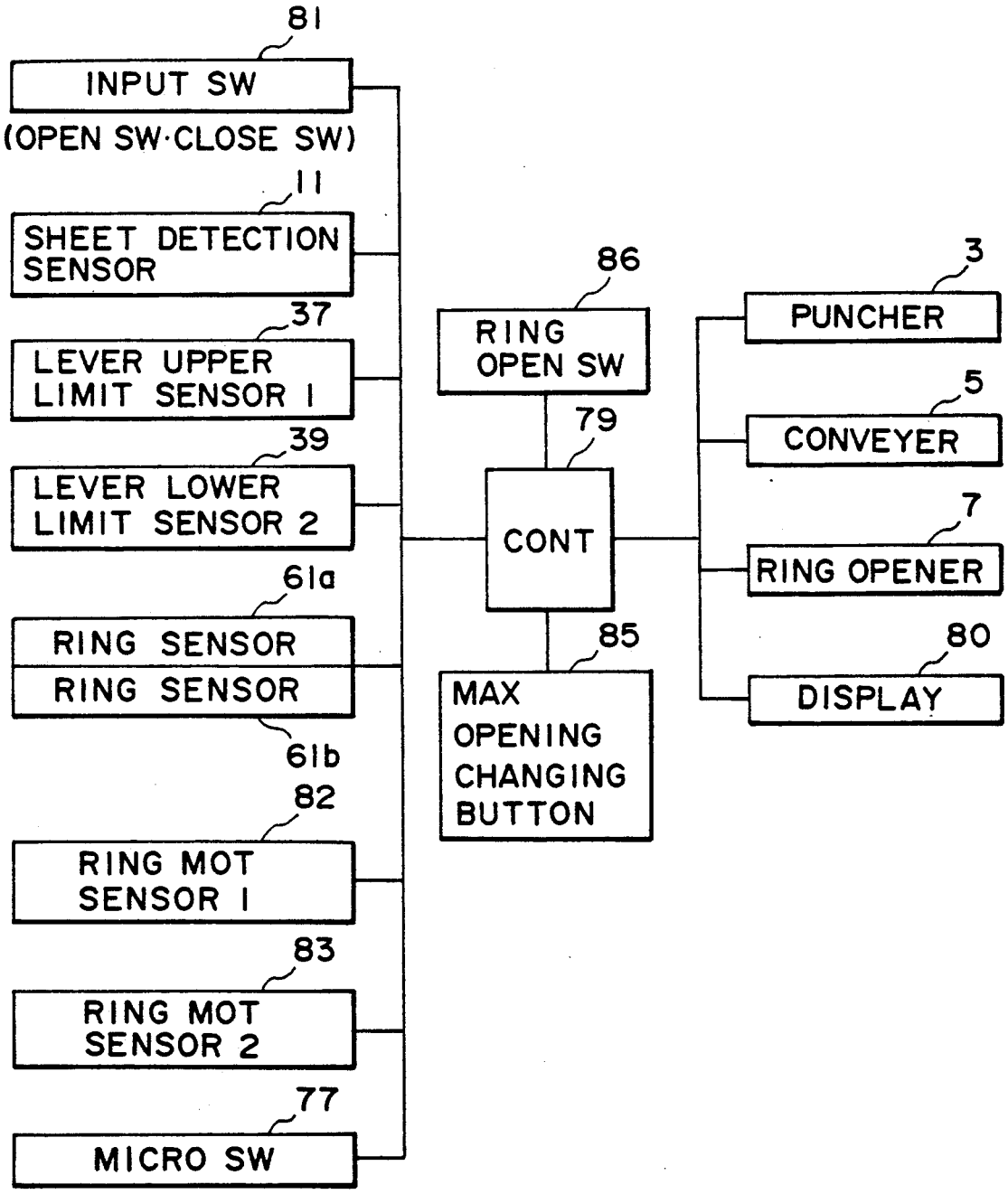
FIG. 18 is a block diagram of a control system used in the apparatus of the second embodiment.

As described in the foregoing, according to the second embodiment described in conjunction with FIGS. 17 and 18, the control means receiving a signal from the size detecting means causes the driving means for the binding member opener to open the binding member to the maximum degree of opening predetermined in accordance with the size of the binding member, and opening beyond the maximum degree is prevented. Therefore, the operator is prevented from opening the binding member too much with the result of improper closure of the binding member. Accordingly, irrespective of the degree of expertise of the operator, the sheet materials can be bound assuredly, and therefore, the operation efficiency is improved.

When, for example, a binding member made of a material which is different from the material of the ring frequently used is used, the maximum opening degree changing means can be easily operated to change the maximum opening degree of the binding member. Therefore, the operable range of the apparatus can be expanded to cover the rings made of different materials. The above advantageous are particularly remarkable in the manual mode operation.

An apparatus of a third embodiment will be described which has the similar structure as the apparatus described in conjunction with FIGS. 1–16, but includes erroneous operation preventing means.

Figure 20:
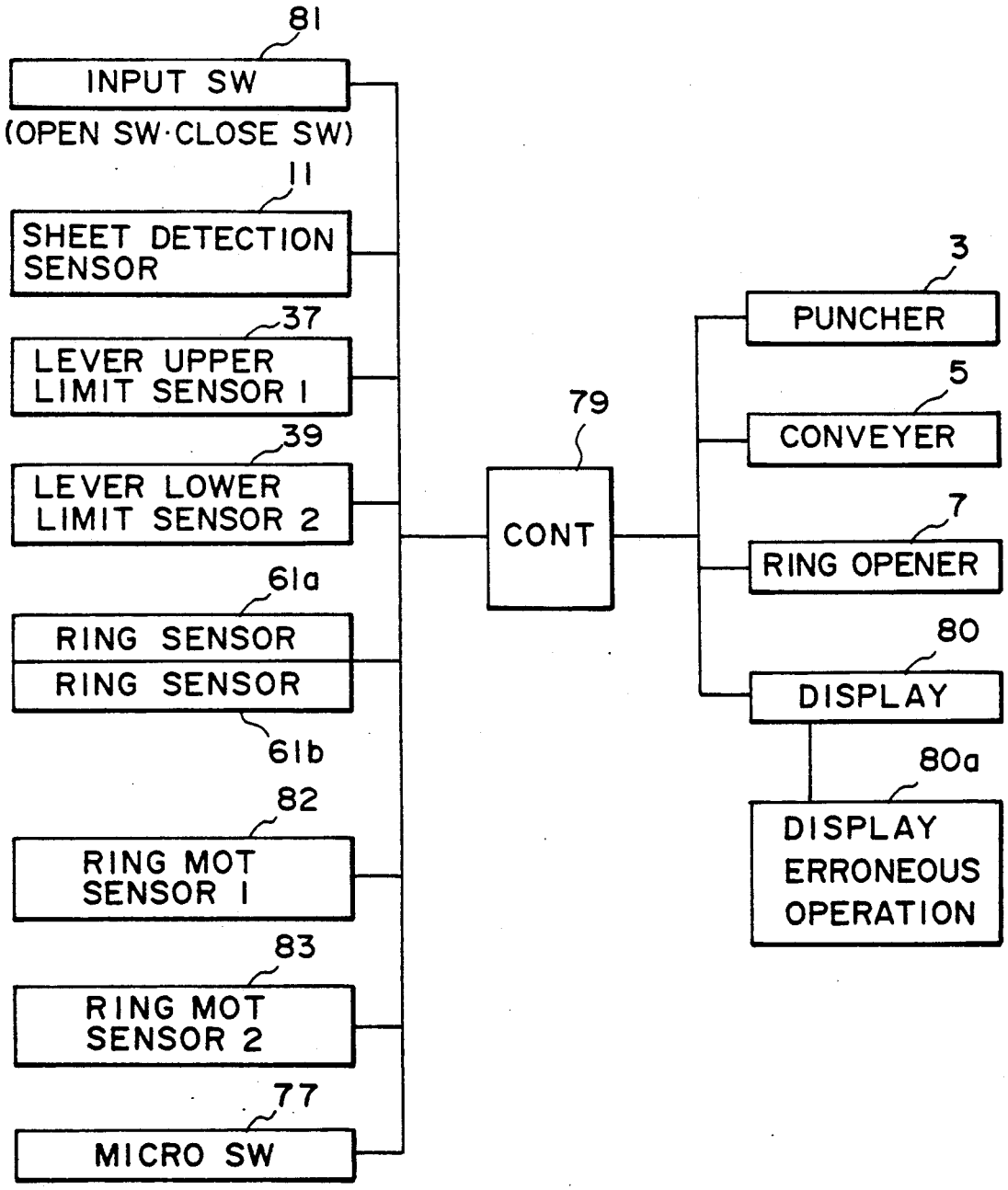
FIG. 20 is a block diagram of a control system used in the apparatus according to the third embodiment.

As shown in FIG. 20, an erroneous operation 80*a* is displayed on the display 80.

Referring to FIG. 20 and FIG. 2A, the operation of the third embodiment apparatus will be described. When the input switch 81 is actuated, and fingers of the ring 6 are set on the upper pawl 52, the sensor lever 60 rotates in the counterclockwise direction about the shaft 60*a*, and the size of the ring 6 is detected by the controller 79 on the basis of a combination of actuation and non-actuation of the plural sensors actuatable by the bottom end of the ring sensor lever 60. Also, the setting of the ring 6 is discriminated. The controller 79 supplies a signal to display the sheet materials to be set (S1).

Figure 19:
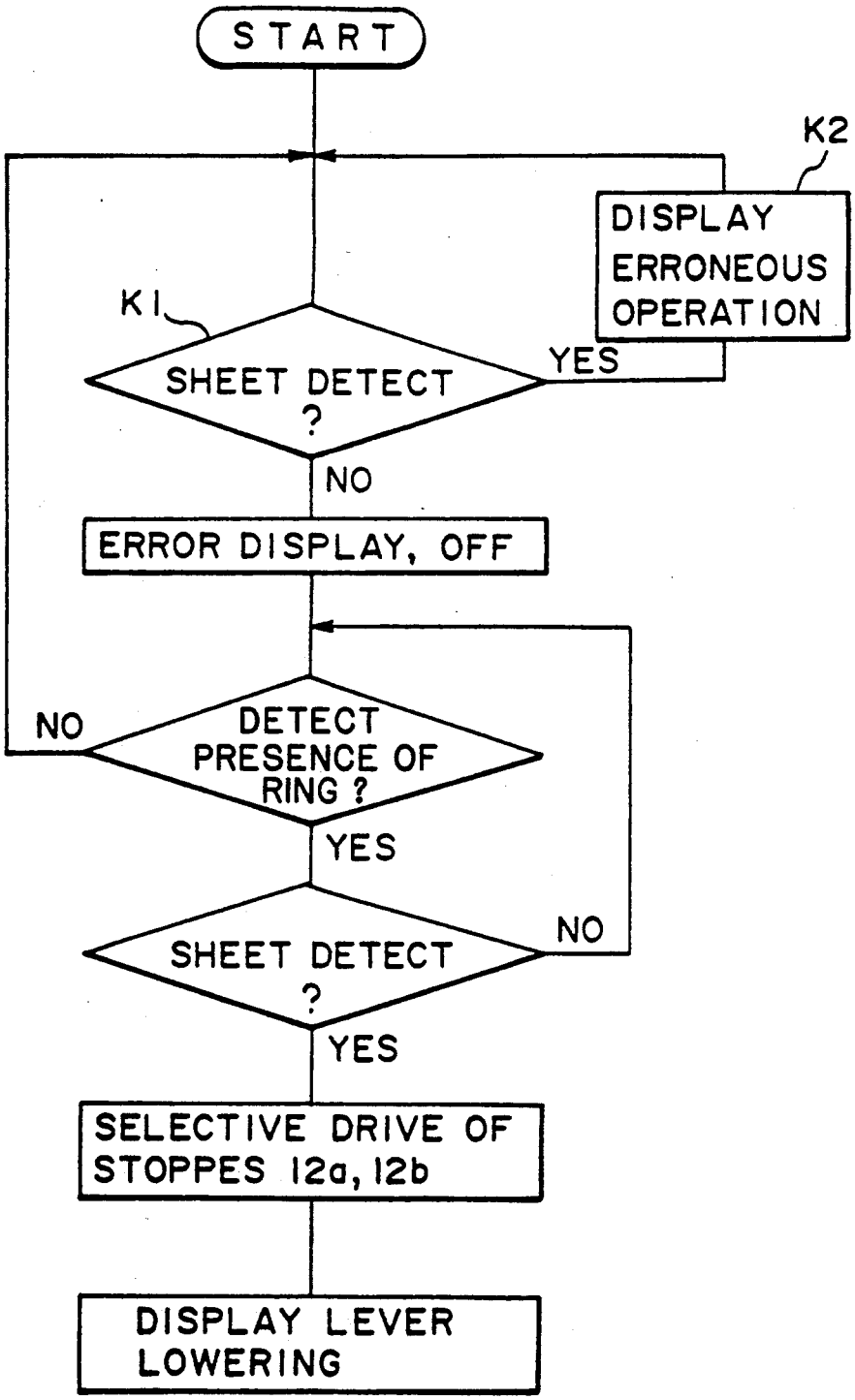
FIG. 19 is a flow chart illustrating an operation of an apparatus according to a third embodiment of the present invention.

As shown at the step K1 in FIG. 19, when the sensor 11 detects the sheet materials 2, the controller 79 receives the signal indicative of that event, and also discriminates presence or absence of the detection signal by the sensor 61. If there is the sensor 61 detection signal, step K2 is executed to display an erroneous operation on the display 80*a*. When the sheet materials 2 are retracted from the sheet material supporting table 9, the erroneous operation display 80*a* disappears. Then, the presence or absence of the ring 6 is inspected, and if no ring is detected, the operation returns to step S1. In place of the display 80*a* of the erroneous operation, "set a ring before setting sheet materials" may be displayed, or the display of the sheet setting may be flickered.

Then, the controller 79 energizes the solenoid 13*a* or 13*b* selectively in accordance with the size of the ring 6 to project the stopper 12*a* or 12*b* through the hole 10*b* of the die 10. Then, the sheet materials are inserted until they are abutted to the stopper 12*a* or 12*b*. Simultaneously, the controller 79 receiving the signal from the sensor 11 transmits a signal to the display 80 to display the lever to be lowered (S2). In FIG. 19, the steps S1 and S2 are shown in detail. When the lever 16 is lowered to such an extent that the upper limit sensor 37 is deactuated by the disappearing of the sensor lever 36*b*, the controller 79 receiving indicative of that event supplies a signal to lower the raised one of the solenoids 13*a* and 13*b* to lower the stopper 12*a* or 12*b* associated therewith. Simultaneously, the pressing arm 29 is pressed downwardly by the lever arm 30, by which the sleeve 23 is lowered against spring forces by the compression springs 27*a* and 27*b*, and the confining plate 26 integral with the pushing rod 25 is pressed to the set of sheet materials 2. The lowered confining plate 26 is locked with the pawl 31*a* of the locking plate 31. Simultaneously, the punches 17 are lowered to punch the sheet materials 2 on the die 10. Further simultaneously, the pick-up arm 42 is pressed downwardly by the sensor lever 36*b* against the upward urging force, and therefore, the pick-up lever 41 is lowered.

Then, the upper conveying roller 40*b* and the lever 44 presses the set of sheet materials 2 by the weight thereof. The controller 79 receiving a signal from the lower limit sensor 39 actuated supplies a signal to energize the solenoid 47 to lock the lever 41 through the core rod 47*a*, the hook 46 and the projection 41*b*, and the lever raising is displayed on the display 80 in response to the signal from the controller 79 (S3). Then, the lever 16 is raised. The controller 79 receiving a signal indicating that the sensor lever 36*b* deactuates the lower limit sensor 39 supplies signals to the drivers for the motors 55 and 59. By the communication with the ring motor sensors 82 and 83, the ring 6 is opened to such a degree as meets with the signal from the sensor 61 relating to the size of the ring 6, and the opened degree is maintained.

On the other hand, when the sensor lever 36*b* actuates the upper limit sensor 37, the punches 17 have already been retracted by the lever 16 through the pressing arm 29. With delay of completion of retraction of the punches 17 from the sheet materials 2, the pressing arm 29 is raised, upon which the locking plate rotates in the counterclockwise direction about the pin 32 through the arm 35 and the releasing link 33, so that the confining plate 26 is released from the pawl 31*a*, and the pressing plate 26 moves away from the set of sheet materials 2. The controller 79 receiving a signal indicative of actuation of the upper limit sensor 37 supplies a signal to actuate the motor 8 for driving the conveying rollers 40*a* and 40*b*, upon which the sheet materials 2 are conveyed to the ring opener 7 by the conveying rollers 40*a* and 40*b*. During the conveyance, the possible disturbance of the leading edge of the sheet materials 2 is prevented by the ring inlet guide 49. The sheet materials are detected by an unshown sensor below the conveying table 50, and subsequently, after the punched portion of the sheet materials 2 are aligned with the edges of the fingers of the link 6 opened as shown in FIG. 12, the ring 6 is closed. The controller 79 receiving a detection signal from the above unshown sensor supplies a signal to deenergize the solenoid 47 to release the projection 41*c* from the engaging portion 46*a*, upon which the conveying roller 41*b* is raised by the urging force of the tension spring 41*d* through the engaging portion 41*e* of the lever 41 through the lever 44.

After the ring 6 is closed, the completion of the binding operation is displayed on the display 80. This is the end of the binding operation (S4). After this, the operator manually retracts the bound sheet materials in the direction opposite to that of the insertion. At this time, the inlet guide 46 and the ring inlet guide 51 rotate in the clockwise direction so as not to impede the retracting operation.

A modification of this embodiment will be described. In the third embodiment, the erroneous operation 80*a* is displayed on the display 80. However, it is a possible alternative that the punching operation, that is, the lowering of the lever 16 or the punches 17 of the punching station is prohibited.

The display 80*a* of the erroneous operation and the locking of the lever 16 or the punches 17 may be employed in combination.

In order to lock the punches 17, a cut-away portion is formed at a side of each of the punches shown in FIG. 1 described in the foregoing, and a horizontally movable locking member is engageable into the cut-away portions. The locking member is driven by a solenoid or the like in response to a signal from the controller 79, so that the punches 17 are locked.

As described in the foregoing, according to the third embodiment described in conjunction with FIGS. 19 and 20, the erroneous operation preventing means produces a display of the erroneous operation if the sheet materials are set to the punching means before the binding member is set on the binding means, whereby the erroneous operation can effectively prevent, an advertent punching of the sheet materials at a position not matching the binding member.

In addition, the punching means can be locked upon the erroneous operation, and therefore, the erroneous operation can completely be avoided. Thus, the erroneous binding operation can be reduced, which significantly reduces the wasteful consumption of the sheet materials. Thus, a proper sheet binding operation can be made automatically with certainty.

An apparatus according to a fourth embodiment will be described which is similar to the apparatus described in conjunction with FIGS. 1-16, but which is added with control mean for automatically closing the ring after a predetermined period of time.

Figure 22:
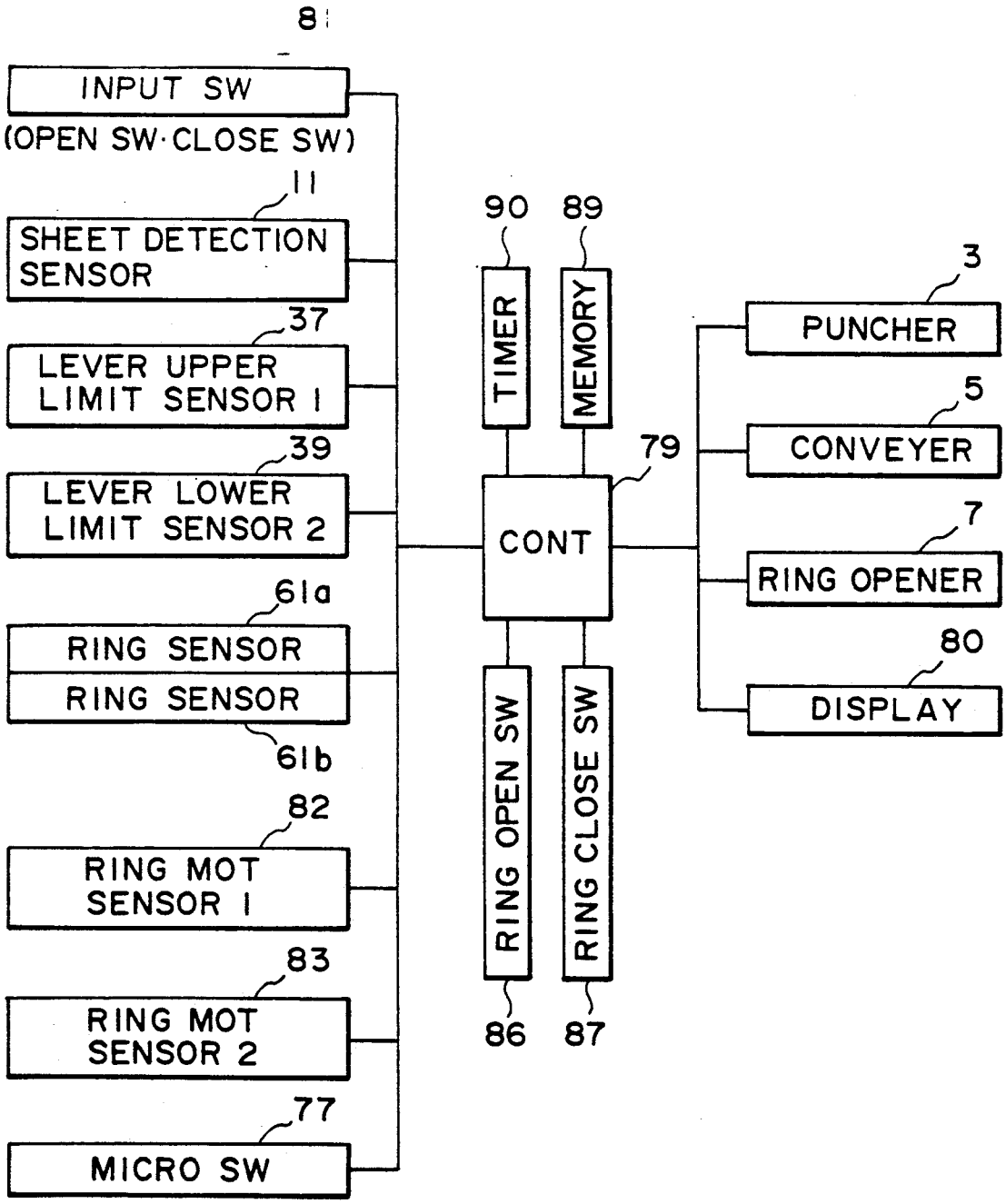
FIG. 22 is a block diagram of a control system used in the apparatus of the fourth embodiment.

As shown in FIG. 22, the apparatus of the fourth embodiment comprises a ring opening button 86, a ring closing button 87, memory means 89 for the degree of opening of the ring and a timer 90 for counting the opening period of the ring 6. The ring opening button 86 functions also to re-open the ring 6. The operation will be described in conjunction with the above-described FIG. 2A and FIG. 22.

In FIG. 2A, an automatic mode is selected, and a switch 81 is actuated. When the fingers of the ring 6 are set on the upper pawls 52, the sensor lever 60 rotates in the counterclockwise direction about the shaft 60*a*. In response thereto, the controller 79 receives from the sensors 61*a* and 61*b* a signal representing a size of the ring 6 and a signal representing the presence of the ring 6. The controller 79 transmits a signal to a display 80 to display a message that the sheets are to be set (S1).

At this time, the controller 79 selectively actuates the solenoid 13*a* or 13*b*, in accordance with the size of the ring 6 detected so as to project the stopper 12*a* or 12*b* through the hole 10*b* of the die 10. Then, the sheets are inserted until they are stopped by the stopper 12*a* or 12*b*. Then, the controller 79 receives a signal from the sensor 11, and a message is displayed on the display 80 that the lever is to be lowered (S2). Then, the operator lowers the lever 16. When the upper limit sensor 37 is deactuated by the disappearing of the sensor lever 36*a*, a signal indicative of that event is transmitted to the controller 79. Then, the elevated one of the solenoids 13*a* and 13*b* is lowered to lower the stopper 12*a* or 12*b*. Simultaneously, the pushing arm 29 is lowered by the lever arm 30, by which the sleeve 23 lowers against the spring forces by the compression springs 27*a* and 27*b*, by which the confining plate 26 integral with the pushing rods 25 presses the set of sheet materials 2. The lowered confining plate 26 is locked by the pawls 31*a* of the locking plate 31. Simultaneously, the punches 17 ar lowered to punch the set of sheet materials on the die 10. Simultaneously, the pick-up arm 42 is lowered by the sensor lever 36*b* against the upwardly urging force. Then, the pick-up lever 41 lowers, and the upper conveying roller 40*b* and the lever 44 presses downwardly the set of sheet materials 2 by the weight thereof. Simultaneously, the controller 79 receiving a signal from the lower limit sensor 39 now actuated deenergizes the solenoid 47, upon which the lever 41 is locked through the core rod 47*a*, a locking portion 46*a* of the hook 46 and the projection 41*c*, and also a message indicative that the lever is to be raised is displayed on the display 80 (S3).

When the lever 16 is raised to such an extent that the sensor lever 36*b* deactuates the lower limit sensor 39, the controller 79 receives a signal indicative of this event, upon which the controller 79 opens the ring 6. On the other hand, when the sensor lever 36*a* actuates the upper limit sensor 37, the punches 17 have been retracted by the lever 16 through the pressing arm 29. With a delay from completion of the retraction of the punches 17 from the sheet materials 2, the locking plate is rotated by the upward movement of the pressing arm 29, in the counter-clockwise direction about the pin 32 through the arm 35 and the releasing link 33, upon which the confining plate 26 is released from the pawl 31*a*, upon which the confining plate 26 is moved away from the sheet material 2.

The controller 79 receiving the actuation of the upper limit sensor 37 produces signals for actuating the stepping motor 8 for driving the conveying rollers 40*a* and 40*b*. The sheet materials are conveyed to the ring opener 7 by the conveying rollers 40*a* and 40*b* through a distance corresponding to a predetermined number of pulses. During the movement, the leading edges of the sheet materials 2 are prevented from being disturbed by the inlet guide 51. The set of sheet materials is stopped at a proper position relative to the ring 6 which is opened as shown in FIG. 12, and thereafter, the ring 6 is closed.

The controller 79 receiving a signal representative of the stepping motor 8 stop produces a signal for deenergizing the solenoid 47, upon which the projection 41*c* is disengaged from the engaging portion 46*a*, and the upper conveying roller 40*b* is raised by the urging force by the tension spring 41*d* through the engaging portion 41*e* of the lever 41 and through the lever 44. After the ring 6 is closed, the display indicative of the completion of the binding operation is made on the display 80. This is the end of the binding operation (S4).

The description will be made as to the operation of preventing the ring 6 from being kept opened beyond a predetermined period in the manual mode.

First, by actuation of the microswitch 77 for the manual mode, the control system is switched to the manual mode. At step K1, the ring 6 is detected, and after the completion of the setting, step K2 is executed. When the sheet materials are punched, step K3 is performed in which the ring 6 is opened by the ring opening button 86 to the degree corresponding to the size of the ring 6. Then, the operator inserts the punched sheet materials 2 into the ring 6 as shown in FIGS. 15 or 16(B) described hereinbefore. Then, step K4 is operated wherein when the ring 6 is closed by the ring closing button 87 within a predetermined period, the sheet material 2 binding operation is completed. If the ring closing button 87 is not actuated within the predetermined time period (3 minutes, for example), step K5 is executed by which the ring 6 is automatically closed. Then, step K6 is executed in which if the operator actuates the ring opening button 86 again after he confirms that the ring 6 is set, then the above operation is repeated.

In the above-description, the completion of the punching is discriminated by the controller 79 receiving the sensor 11 actuation signal, the upper limit sensor 37 deactuation signal, the lower limit sensor 39 actuation signal, the lower limit sensor 39 deactuation signal and the upper limit sensor 37 actuation signal. The determination of the degree of the opening may be carried out on the basis of a pulse count when the motors 55 and 59 driving the upper and lower pawls 52 and 56 are stepping motors. Alternatively, it may be determined by counting pulses proportional to the number of revolutions when a motor having an encoder is used to determine the amount of the movement of the upper and lower pawls 52 and 56. The ring 6 is opened to such a degree as corresponds to the size by the memory 89 for the opening degrees. The time limit for keeping the ring 6 opened can be set in the timer 90.

The above-description has been made as to the manual mode operation shown in FIG. 22. However, this embodiment is applicable in the case where the sheet materials 2 are jammed during conveyance in an automatic mode, and the operator leaves the apparatus as it is.

Figure 21:
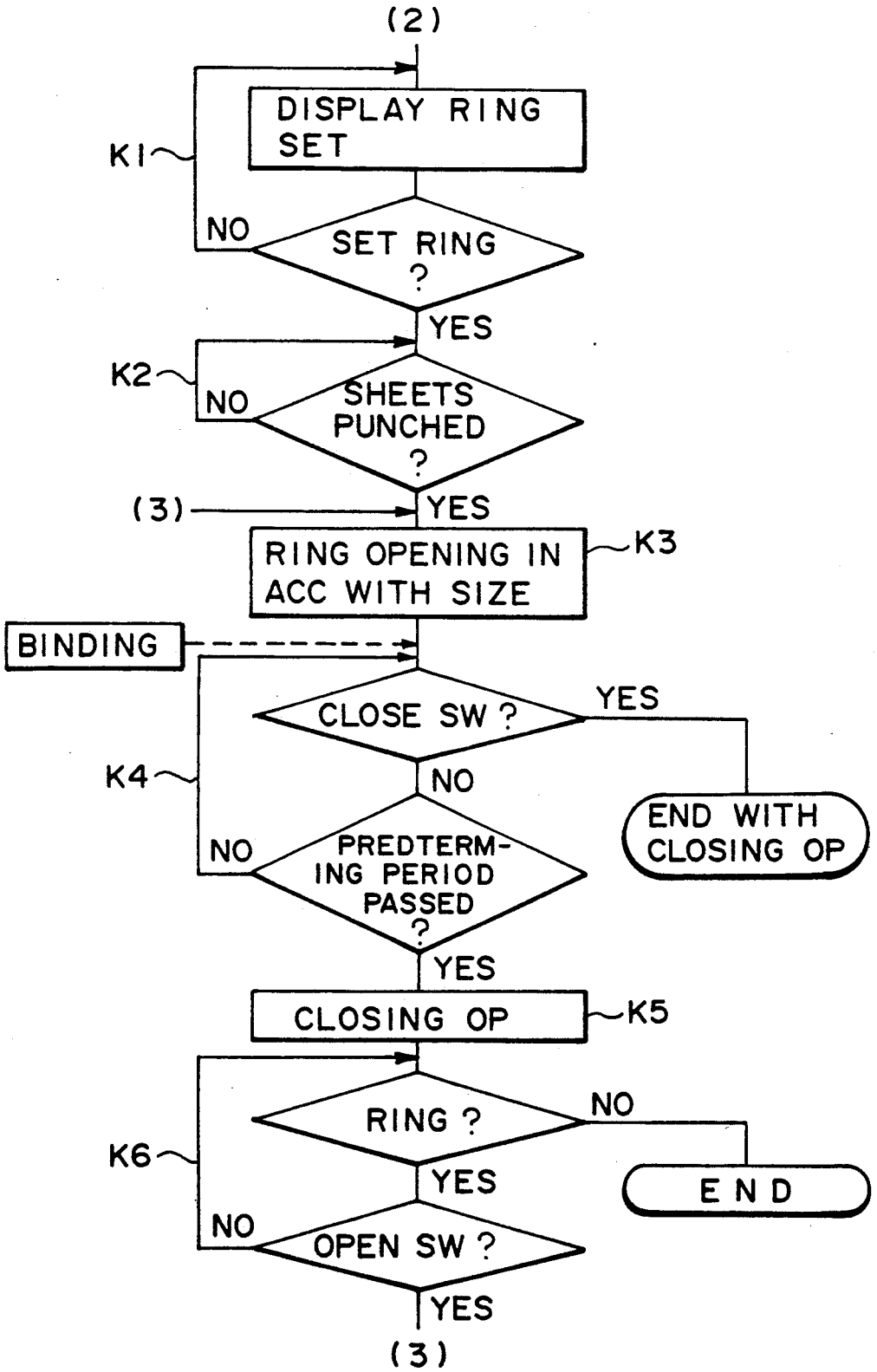
FIG. 21 is a flow chart in a manual mode of an apparatus according to a fourth embodiment of the present invention.

According to the fourth embodiment described in conjunction with FIGS. 21 and 22, even if the opening of the binding member is kept open during the binding operation, the ring is automatically closed after the predetermined period of time has elapsed. Therefore, the ring is kept opened for a long period which can result in yielding of the material of the binding member or in improper closure of the opening. Therefore, the binding operation is assured.

When the binding member having been closed is to be re-opened, it can be opened by the re-opening instruction means to the degree of opening corresponding to the size of the binding element. This prevents the binding member from being opened too much during the re-opening period. If it is opened too much, the material of the binding member yields. Therefore, the re-binding operation can be made easier and assured.

An apparatus of a fifth embodiment will be described. The same reference numerals as in FIGS. 4, 5, 6, 7, 8, 10, 13, 14 and 16 are assigned to the elements having the corresponding functions, and the detailed description thereof are omitted for simplicity.

Figure 23:
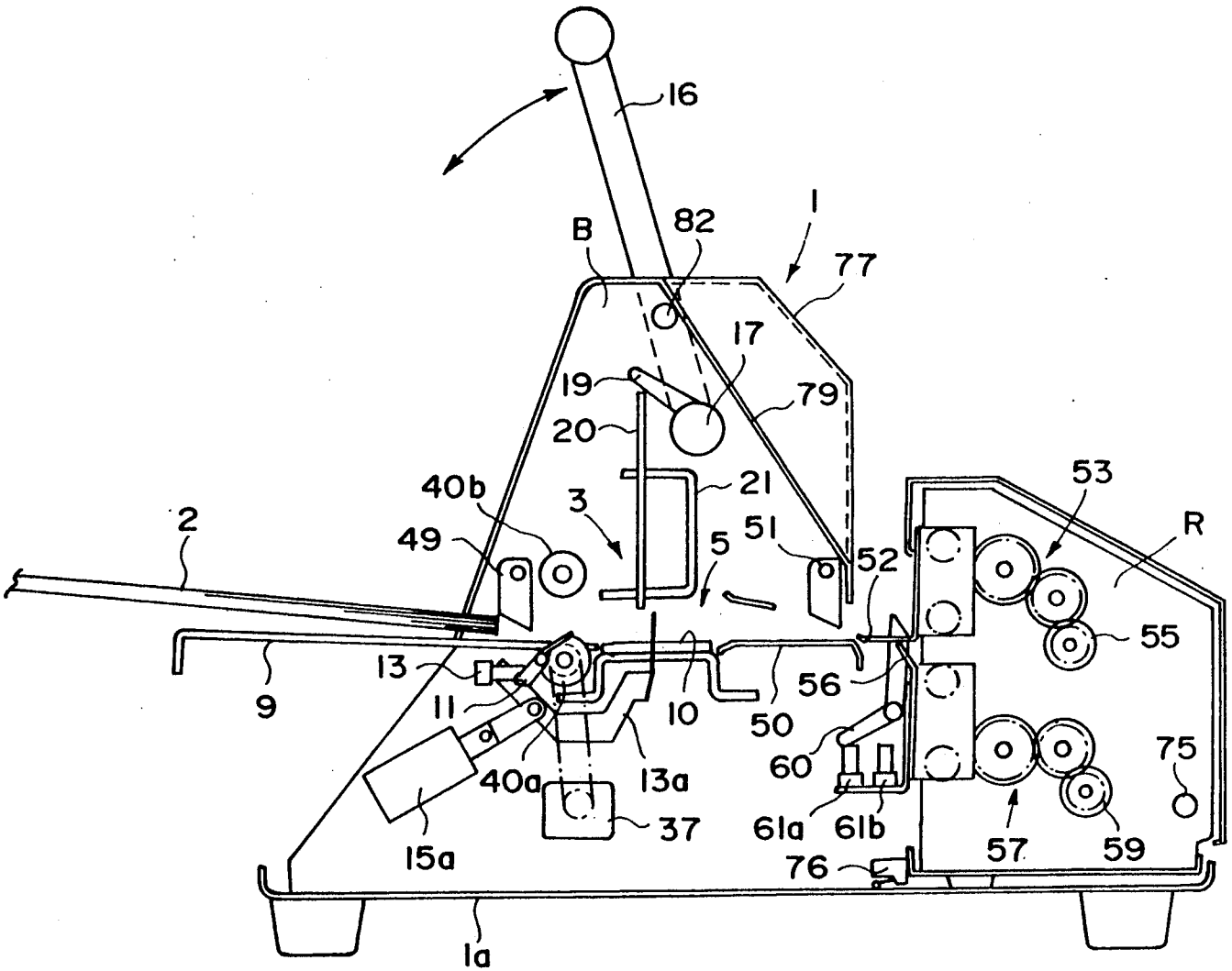
FIG. 23 is a sectional view of a sheet material binding apparatus according to a fifth embodiment of the present invention.
Figure 24:
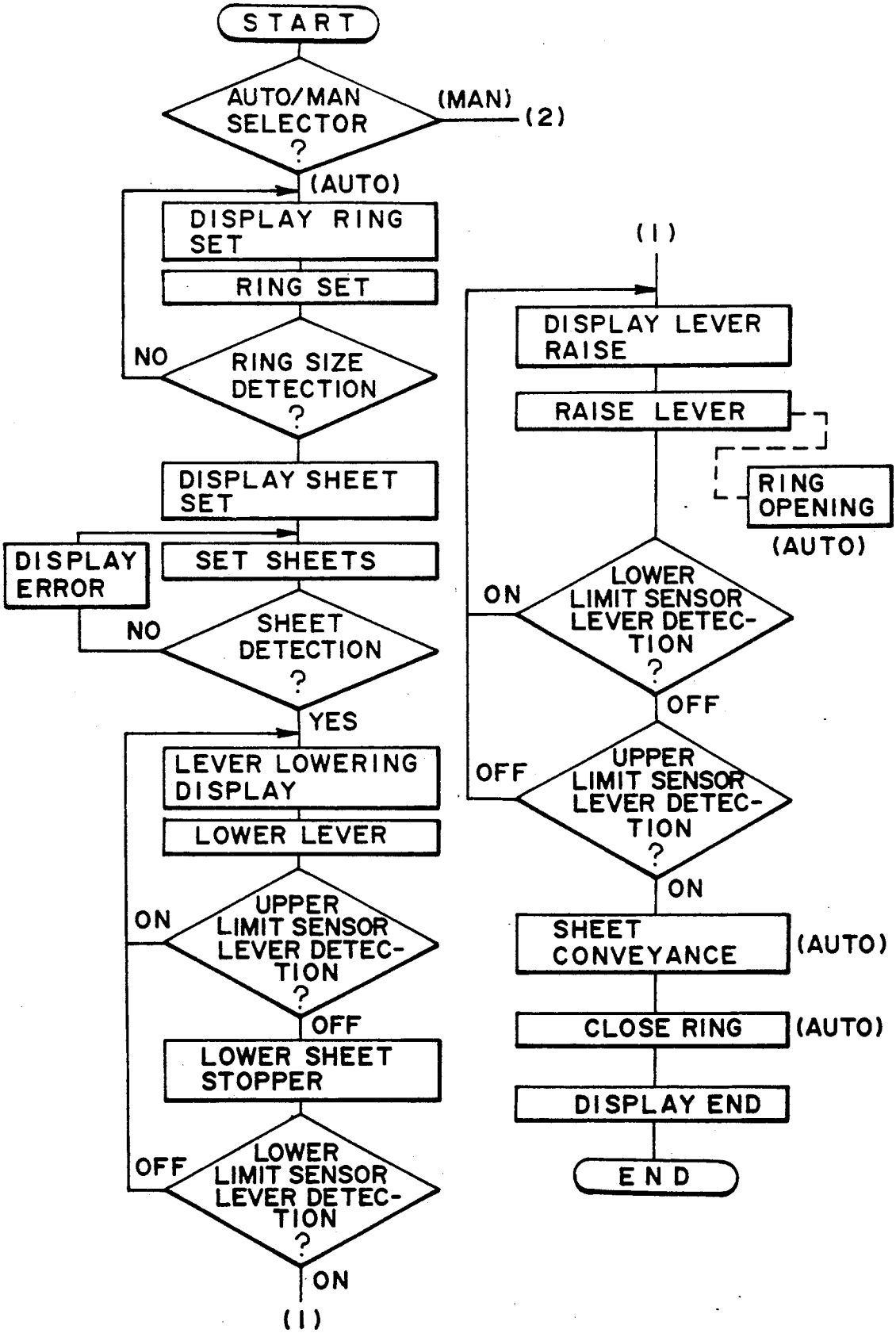
FIG. 24 is a flow chart illustrating an operation of the apparatus according to the fifth embodiment.

FIG. 23 is a longitudinal sectional view of a sheet binding apparatus according to this embodiment. FIG. 24 is a flow chart illustrating the operation of the apparatus. The flow chart of FIG. 24 deals with the automatic mode in which the operation from the punching to the binding are automatic and a manual mode wherein the punching and the binding operations are carried out separately.

First, the automatic mode will be described in conjunction with FIGS. 23 and 24. The sheet binding apparatus 1, as shown in FIG. 23, comprises punching means 3 for punching the set of sheet materials 2, conveying means 5 for conveying the set of sheet materials 2 punched by said punching means and binding means R for opening and closing a plastic resin ring 6 (FIG. 25) for binding the sheet materials 2 conveyed by said conveying means. They are mounted on a base plate 1*a* of the sheet material binding apparatus.

The punching means 3 will be described in conjunction with FIGS. 23 and the above-described FIG. 7. As shown in FIG. 23, the die 10 is disposed close to the sheet material supporting table. The die member 10 is provided with holes through which an end of the sensor lever 11 for detecting presence and absence of the sheet materials and a lower conveying roller 12 are projected, respectively. The other end of the sensor lever 11 is associated with a sensor 13 for detecting the sheet materials 2.

Figure 10:
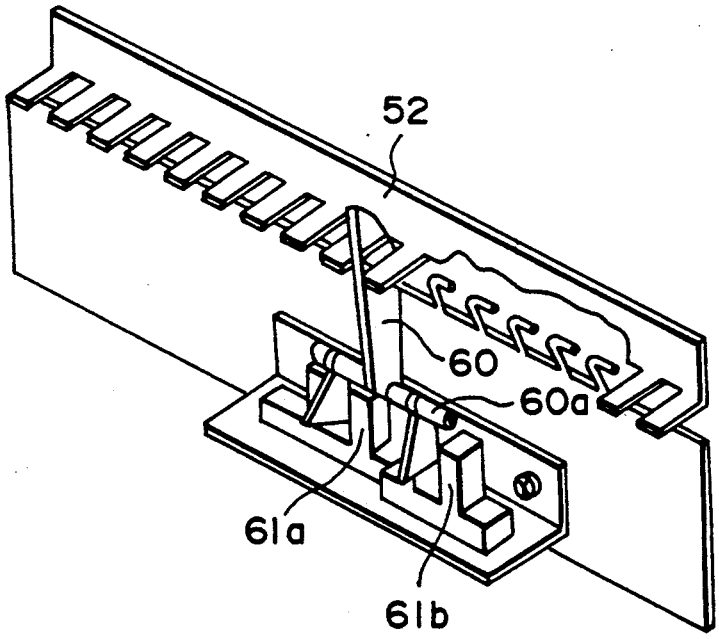
FIG. 10 is a perspective view illustrating an upper and lower pawl.
Figure 11:
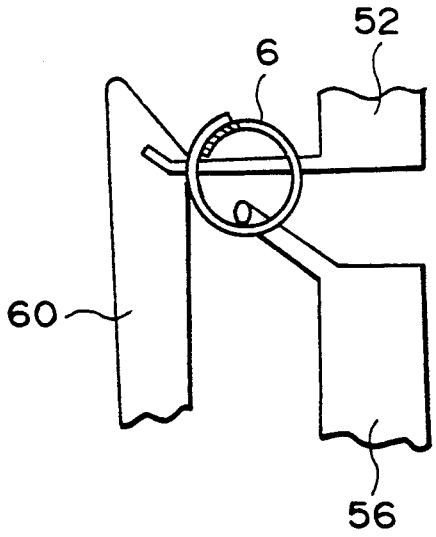
FIG. 11 is a side view illustrating a binding member set in the upper pawl.

As shown in FIGS. 23, 9 and 10, to the shaft 17 to which the lever 16 is fixed, the arm 19 is fixedly mounted, so that when the lever 16 is rotated downwardly, the punches 17 are guided by the guides 22 and 23 formed in the supporting frame 21 to penetrate the punching hole 10*a* of the die 10. As shown in FIGS. 9 and 11, the die 10 and the supporting frame 21 are fixedly mounted on the base frame 22*a*. On the supporting frame 21, the guides 22 and 23 are fixed. When the lever 16 is rotated downwardly, the supporting frame 21 lowers. At this time, the confining plate 26 is lowered to confine the sheet materials 2. The lower position of the confining plate 26 is locked by the locking plate 29, and is released by the releasing plate 31.

Referring to FIG. 23, 3, 25 and 26, the ring opening means 7 will be described.

In the automatic mode, the plastic resin ring 6 (resin ring) is set on the upper supporting member 52 shown in FIG. 10. In the initial state, the ring sensor lever 60 is urged to the upper supporting member 52 by an elastic member, but by setting the resin ring 6 on the upper supporting member 52, it rotates in the counterclockwise direction in FIGS. 10 and 25, so that the bottom end portion thereof blocks the ring sensors 61*a* and 61*b*, by which the presence of the resin ring 6 is detected. A plurality of such ring sensors 61*a* and 61*b* are used, so that the size of the resin ring 6 is detected on the basis of combinations of "on" and "off" of the sensors.

Several sizes of the resin rings 6 are usable depending on the thickness of the set of the sheet materials desired to be bound. The detection of the ring size is used to set a level in the next operation, by which the operation after the punching is made automatic.

The sheet materials 2 are set from the operator's side (left side in FIG. 23). Then, as shown in FIG. 7, the sheet materials 2 are abutted to the stopper 13*a* to regulate the punching position for the sheet materials 2. The sheet material limiting means (inlet guide) 49 is effective to prevent the leading edge portions of the sheet materials 2 from being elevated.

Figure 27A:
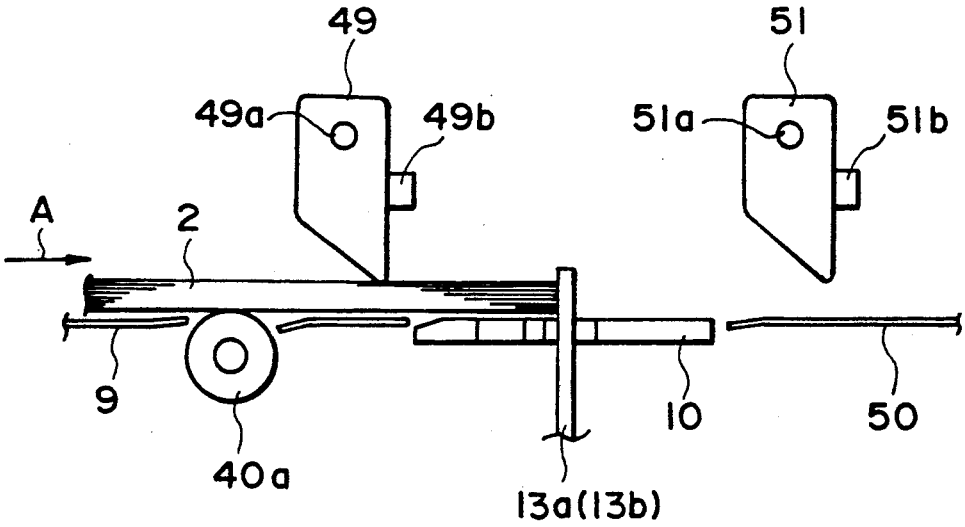
FIGS. 27A & 27B are side views of a conveyance passage.

When the sheet materials 2 are bound, the sheet materials 2 are inserted in the direction indicated by an arrow A in FIG. 27A. At this time, the sheet material limiting means 49 abuts to a stopper 49*b* by its weight to maintain a constant gap x between the sheet material limiting mean 49 and the die 10. The gap x is determined on the basis of the punching power. The set of sheet materials 2 having a thickness not less than the gap X is rejected by the sheet material limiting means 49, and therefore, is rejected by the apparatus. By doing so, improper punching and the improper binding operations are prevented.

Figure 27B:
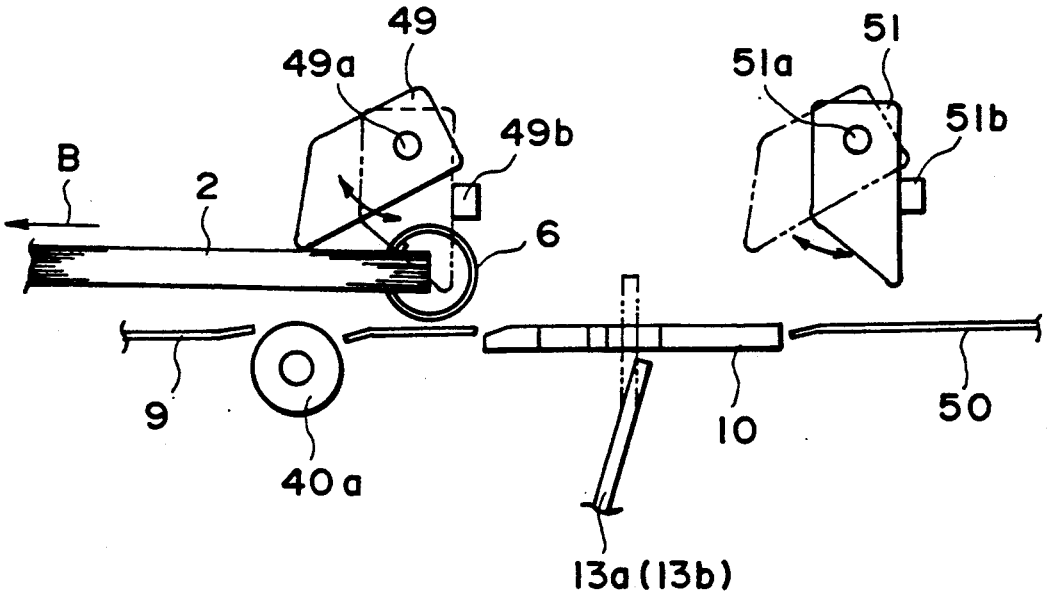

The sheet materials 2 having been inserted and having been subjected to the punching and binding operations are retracted in the direction B in FIG. 27B. At this time, the edges of the sheet materials 2 are bound by the resin ring 6. Therefore, the maximum thickness of the set of sheet materials 2 is increased, but the sheet material limiting means 49, as shown by solid lines in FIG. 27B, is retractable in the clockwise direction so as not to interfere with the retracting operation, so that the sheet materials 2 bound can be easily taken out. As described in the foregoing, by limiting the thickness of the set of the sheet materials 2 by the sheet material limiting means 49, the improper punching or the improper binding attributable to the improper punching can be avoided, and the binding operations can be continued in the stabilized manner. When the sheet materials are placed on the supporting table 9, the sensor lever 11 rotates to block the sheet sensor 13 to detect the presence or absence of the sheet material.

It is preferable that the punching position on the sheet materials 2 is changed in accordance with the size of the resin ring 6 to be used. By setting the resin ring 6 on the upper supporting member 52 in the binding station, the ring sensor lever 60 operates so that the size of the resin ring 6 is detected by the ring sensors 61*a* and 61*b*. Then, the stopper 13*a* or 13*b* is interrelatedly moved to regulate properly the punching position on the sheet material 2.

In this embodiment, two punching positions are provided. On the basis of the signal after the resin ring 6 is set, either one of the solenoid 15*a* or solenoid 15*b* is selected to retract non-selected solenoid 15*a* or 15*b*, and the selected stopper is abutted by the sheet materials. The number of the stopper are not limited, and it or they may be movable.

The punching process will be described. As shown in FIG. 6, punches 17 are supported by guides 22 and 23 constituting a pair with the die 10. In this embodiment, each of the guides 22 and 23 is constituted by three elements for the manufacturing convenience. It may be one part. The structure which is separate in the vertical direction is employed to permit retraction of the set of sheet materials 2 bound by the resin ring 6 toward the inlet side after the completion of the operation.

In order to punch the sheet materials 2 abutted to the stoppers 13*a* and 13*b*, the lever 16 is lowered. The position of the lever 16 is detected by the sensor levers 32*a* and 32*b* rotatable together with the lever 16 and by the upper limit sensor 35 and the lower limit sensor 36. When the lever 16 is lowered by the cam mechanism constituted together with the shaft 15, the punches 17 moves downwardly and upwardly, so that the sheet materials are punched.

In this embodiment, the upper conveying roller 40*b* and the lower conveying roller 40*a* are disposed with a gap therebetween to constitute a pick-up structure as shown in FIGS. 5 and 9. When the sheet materials 2 are inserted to abut the stopper 13*a* or 13*b*, the upper conveying roller 40*b* is retracted out of the conveying path, and after the punching operation is completed, the upper roller 40*b* is lowered to convey the sheet material 2 to the binding station.

In this mechanism, when the lever 16 is lowered, the lower limit sensor lever 32*b* rotates, and simultaneously with blocking the lower limit sensor 36, the pick-up arm 42 is lowered. By this, the pick-up lever 41 rotatable together with the pick-up arm 42 is lowered, so that the upper conveying roller 40*b* lowers by its weight, by which the sheet materials 2 are sandwiched by the upper and lower conveying rollers 40*a* and 40*b* to be stably conveyed. At this time, in order to prevent the returning of the pick-up lever 40, a pin 41*c* fixedly mounted on the pick-up lever 41 is locked by a pawl 46*a* of an end portion of the locking arm 46.

After the sheet materials 2 are punched, the lever 16 is moved upwardly to retract the punches 17 from the sheet materials 2. At this time, due to the friction between the punches 17 and the sheet materials 2, the sheet materials are elevated. If the punches 17 are retracted after abutment to the guide 23, the sheet materials 2 are pulled obliquely, and therefore, they are deviated from the position determined by the stopper 13*a* or 13*b*. In consideration of this, the sheet materials 2 are confined by a sheet confining mechanism shown in FIG. 12. In this mechanism, the confining member is urged to the guide 23 by the spring 27 at the initial state, but it is lowered together with the operation of the lever 16 to confine the sheet materials 2 to prevent the deviation of the sheet materials 2 during the punching operation. After the punching operation, the locking plate 29 prevents the confining member from returning, in order to assist the retraction of the punches 17. More particularly, immediately before the lever 16 passes by the upper limit sensor 35, that is, when the punches 17 are all retracted from the sheet materials 2, the cam mechanism of the releasing plate 31 resets the confining member.

When the completion of the punching operation is detected by the upper sensor 35, the solenoid 15*a* or 15*b* retracts the stopper 13*a* or 13*b*. Thereafter, the conveying motor 37 simultaneously drives the lower conveying roller 40*a* and upper conveying roller 40*b* through the belt and gear, so that the sheet materials are conveyed. Only one of the upper conveying roller 40*a* and lower conveying roller 40*b* may be driven to convey the sheet materials 2, but, in order to assure the conveyance accuracy, both of the upper and lower rollers are preferably driven when a great number of sheets are conveyed.

The sheet materials 2 conveyed are fed to the ring opener 7 through the conveying table 50. A ring inlet regulating plate 51 is disposed in the conveyance passage to limit the gap in order to prevent the curling an disturbance of the leading edges of the sheet materials 2 and in order to assure the binding of the sheet materials 2 by the resin ring 6.

Now, the ring opener will be described. As shown in the right half of FIG. 23, the ring opener comprises an upper supporting member 52, a lower supporting member 56 and gear trains 53, 57 and motor 55 and 59 for driving them, and a sensor for detecting the size of the resin ring 6.

When the resin ring 6 is interposed between the upper supporting member 52 and the ring sensor lever 60, the size of the resin ring used is detected, and in response to the detection, the degree of opening of the resin ring 6 is determined. The degree of the opening is different depending on the resin ring 6 used. The resin ring 6 is opened by the upper supporting member 52 and the lower supporting member 56, and the movement amounts thereof are different.

The description will be made a to the resin ring 6 according to an embodiment of the present invention.

Figure 30A:
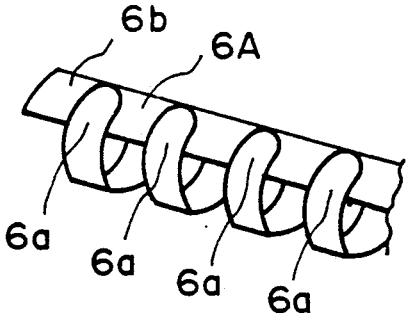
FIG. 30A is a perspective view of a conventional plastic resin ring.
Figure 30B:
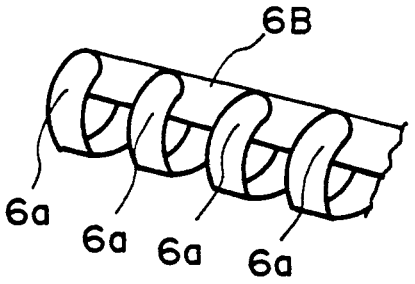
FIG. 30B is a perspective view of a plastic resin ring according to an embodiment of the present invention.

FIG. 30A shows a conventional resin ring 6A. FIG. 30B shows the resin ring 6B of the present invention. In the conventional resin ring 6A, the longitudinal ends of a spine 6B are extended beyond the most outside pawls 6A. In the present invention, the pawl 6A and the spine 6B are flush with each other at a reference longitudinal end of the resin ring 6B.

Figure 31A:
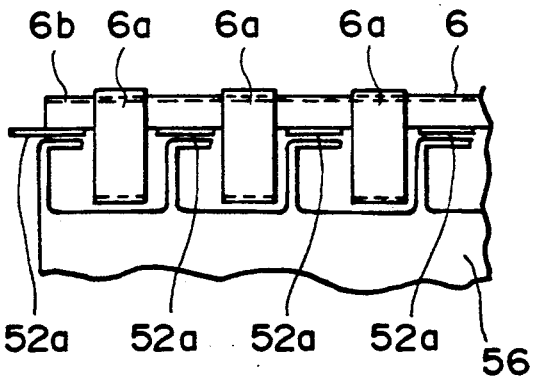
FIG. 31A is a front view of the apparatus wherein the conventional ring is set in binding means.

When the conventional resin ring 6A is set in the conventional binding apparatus, it can be set irrespective of the orientation of the resin ring 6A, as shown in FIG. 31A. If, therefore, the open side of the resin ring 6A does not correspond to the sheet material 2 side, the sheet materials 2 are not able to enter the resin ring 6A, so that the binding operation is not possible.

Figure 31B:
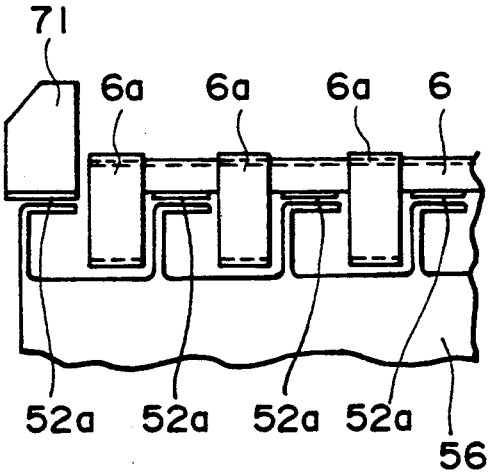
FIG. 31B is a front view wherein the ring according to the embodiment of the present invention is set in the binding means.

On the contrary, when the resin ring 6B of the present invention is set in the binding apparatus according to this embodiment, it is assured that the resin ring 6B is set in a predetermined orientation because of the provision of a limiting member 71 of the binding means, as shown in FIG. 31B. Therefore, it is assured that the open side of the resin ring 6B is at the sheet material 2 side. Therefore, the binding operation can be properly carried out.

Figure 25:
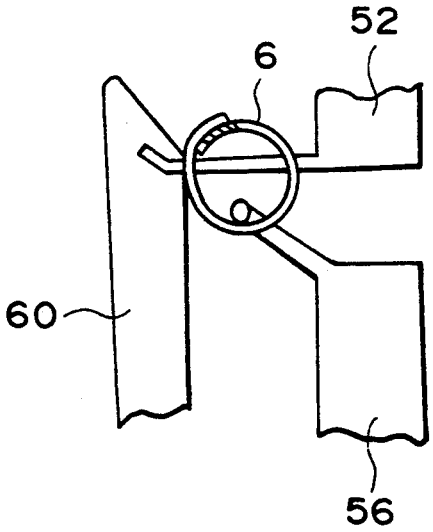
FIG. 25 is an enlarged view wherein a ring is set.
Figure 26:
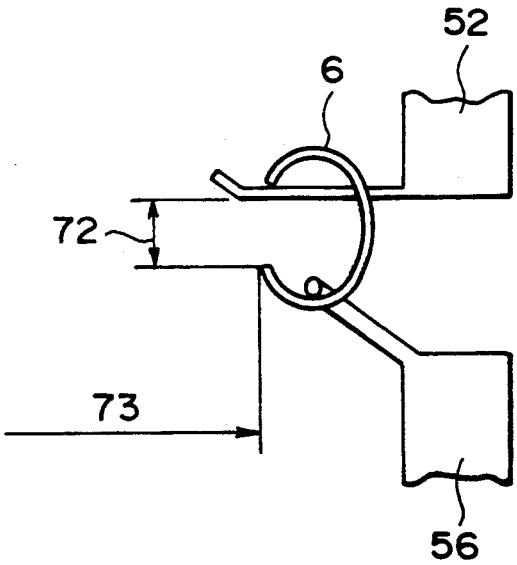
FIG. 26 is an enlarged view illustrating the opening of the ring.

Referring to FIGS. 25 and 26, the description will be made as to the opening operation of the resin ring 6. The set resin ring 6 is supported by the upper supporting member 52, and is sandwiched thereby together with the ring sensor lever 60. The lower supporting member 56 having a hook shape translates into the inside of the resin ring 6 by an unshown cam mechanism, as shown in FIG. 13. Thereafter, the upper supporting member 52 and the lower supporting member 56 are moved to the predetermined opening degree to open the resin ring. In this embodiment, as soon as the upper limit sensor 35 detects the completion of the punching operation, the opening operation is started. However, the timing of the opening operation may be changed if it is before the sheet materials 2 reaches the predetermined position. The open state is as shown in FIG. 26. As for the degree of opening 72 of the resin ring and the position 73 of the leading end of the ring, they may be empirically determined by one skilled in the art so that as many as possible sheet materials 2 can be bound provided that the elasticity limit is not exceeded in consideration of the fact that the resin ring 6 is elastic. By doing so, the resin ring 6 is opened to the proper extent for the respective resin rings 6 set in the apparatus, without wondering what is the correct degree of opening.

Since the conveyed sheet materials 2 have the punched holes at correct position determined in accordance with the size, they are conveyed to the position where the centers of the punched holes are aligned with the free ends 73 of the ring pawls. Upon completion of the conveying operation, the upper supporting member 52 and the lower supporting member 56 are moved in the same direction so that the degree of the opening remains unchanged. The movement continued until the free ends of the ring pawls penetrate the punched holes of the sheet materials 2. After the penetration, the upper supporting member 52 and the lower supporting member 56 are moved to close the opening. Finally, the bound sheet materials 2 are pulled out. At this time, the regulating member 71 and the ring inlet regulating plate 51 are rotatable so as not to interfere with the retraction of the sheet materials 2.

The operations at the respective steps described above are displayed on the operation panel, so that the operator is sequentially given the instructions until the final step. The control system is as shown in FIG. 3.

The operation in the manual mode will be described in conjunction with FIGS. 23, 15, 28 and 29.

Usually, the automatic mode is effective to bind the set of sheet materials 2 having a thickness smaller than the punching power of the binding apparatus. When the number of sheet materials exceeds the punching power, the automatic mode is not used, but after several sets of sheet materials 2 each having a thickness smaller than the punching power are punched and thereafter, they are bound together by the resin ring 6. In addition, when additional sheet materials 2 are desired to be bound together with the already bound sheet materials 2, or when a part or all of the bound sheet materials are desired to be exchanged with another set of sheet materials, the manual mode rather than the automatic mode is used.

Figure 28:
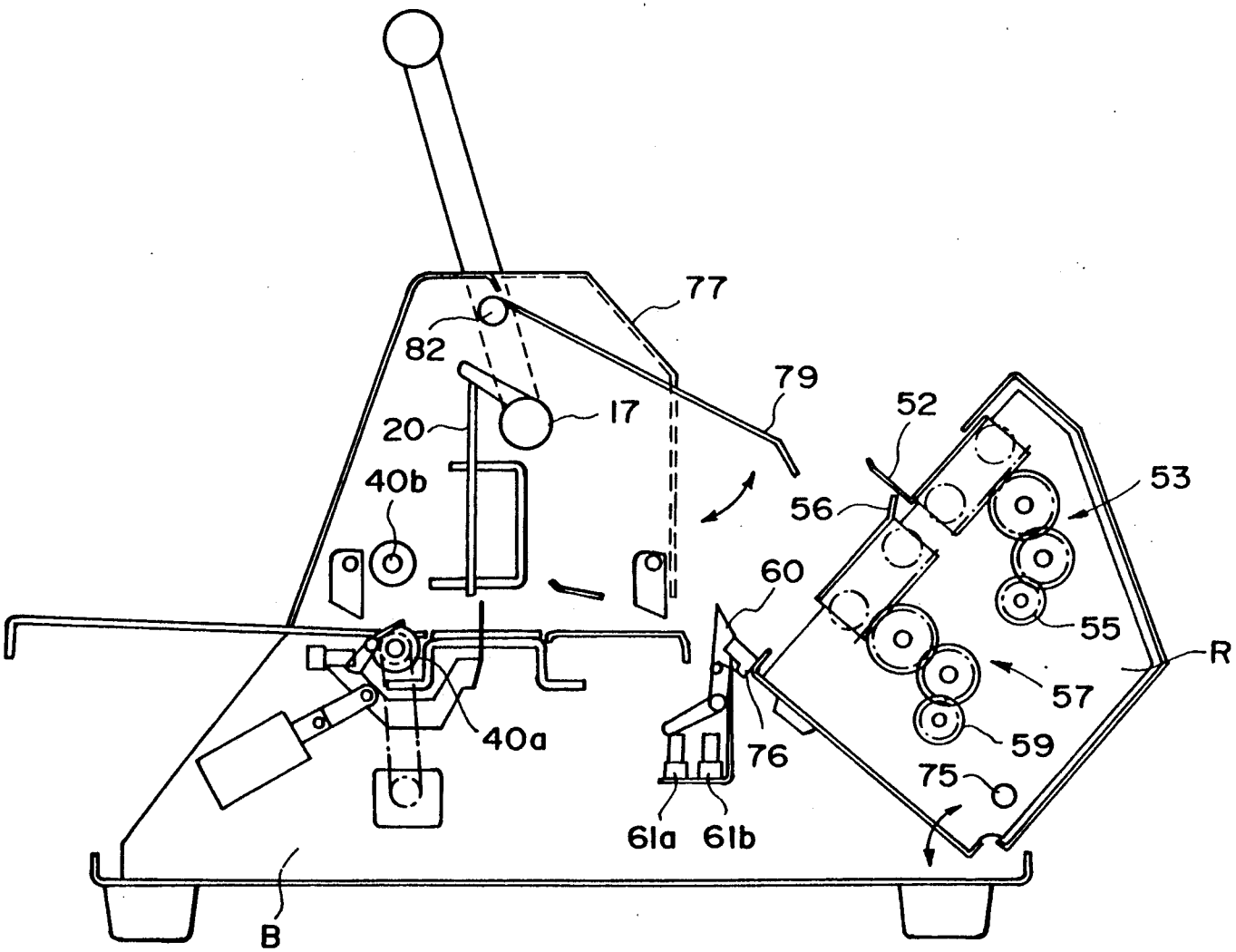
FIG. 28 is a sectional view of the sheet material binding apparatus of the fifth embodiment in a manual mode.

When the sheet materials 2 are to be bound in the manual mode, the binding means R in FIG. 23 is rotated about the pivot 75 in the clockwise direction, and is fixed at the position shown in FIG. 28 by an unshown fixing system. When the mode switching switch 76 mounted on the binding means R is rotated to be rendered off, the manual mode is detected. An auxiliary guide cover 79 mounted on the cover 77 of the automatic sheet material binding apparatus B is also rotated in the counterclockwise direction to the position shown in FIG. 28. The auxiliary guide cover 79, during the automatic mode, is interrelated with an unshown cover of the binding means R, and is retained at the position shown in FIG. 23. During the manual mode, it is moved to the position shown in FIG. 28 by an unshown elastic member.

The operation will be described.

First, the resin ring 6 used to bind the sheet materials is opened by the upper supporting member 52 and the lower supporting member 56. The sheet materials 2 to be bound together are divided into several sets each having a thickness less than the maximum punching thickness of the apparatus. Each of the sets are punched in the process described hereinbefore. The punched portions are inserted through the opening of the resin ring and are received by the pawls 6A, sequentially. After the desired sets of the sheet materials 2 are received, the resin ring 6 is closed, and the sheet materials 2 bound are pulled out. This is the end of the binding operation. When the sheet materials 2 are inserted into the resin ring 6A, the auxiliary guide cover 79 functions as a guide and supporting table for the sheet materials, as shown in FIG. 28, and therefore, the inserting operation of the sheet materials 2 into the resin ring 6 is easy.

Since the ring sensors 61*a* and 61*b* are mounted on the automatic sheet material binding apparatus B, it is not usable in the manual mode provided by inclining the binding means R. Usually, several sizes of the resin rings 6 are prepared, the amount of the opening of the ring is determined by the operator.

Figure 29:
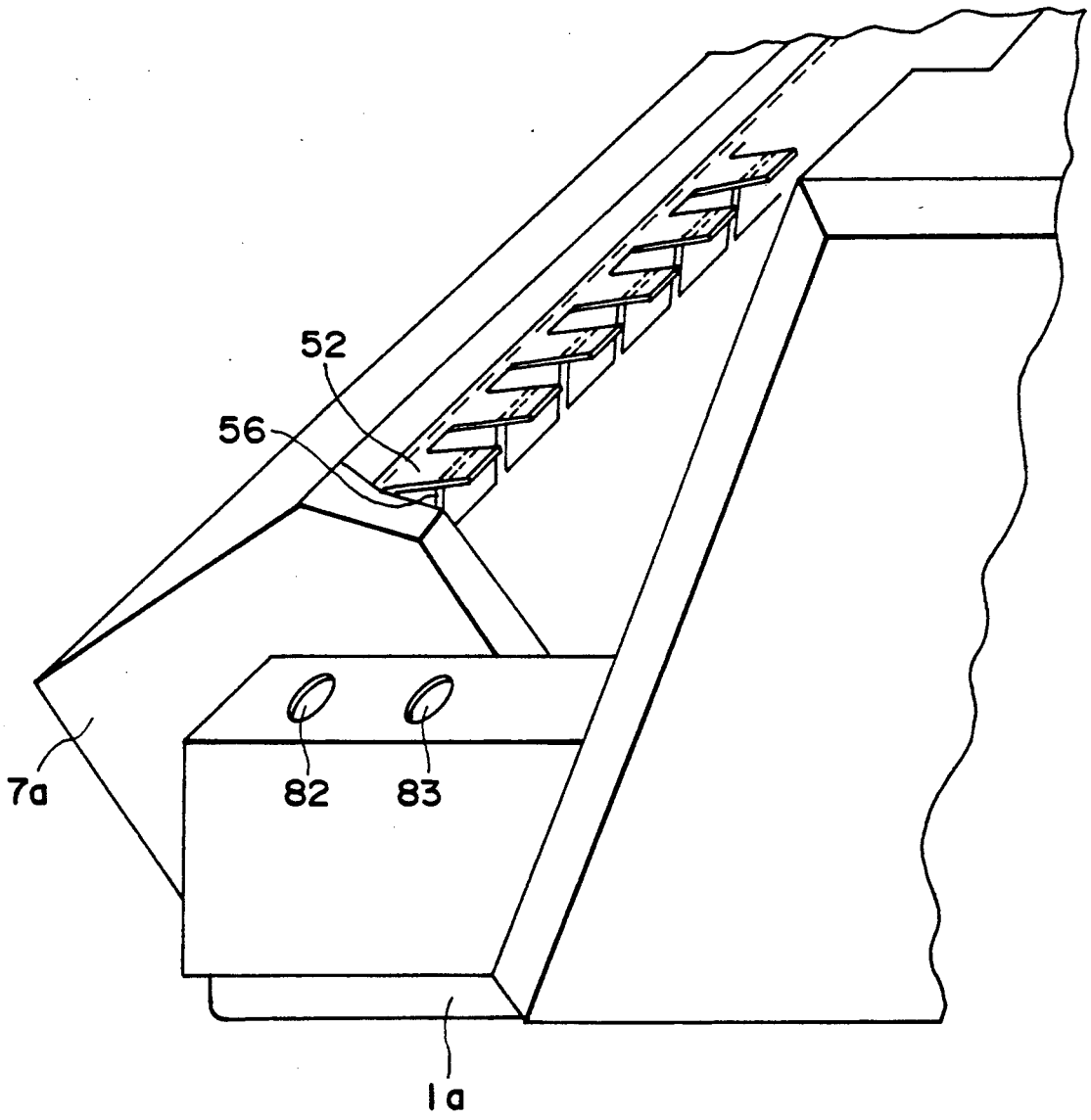
FIG. 29 is a rear perspective view thereof.

Since the degree of opening for the respective resin rings 6 are stored in the apparatus, the operator sets the resin ring 6 on the upper supporting member 52, and depresses optimum times the ring opening button 80 shown in FIG. 29 to provide the required degree of the opening for the resin ring 6. Upon the completion of the inserting operation, the ring closing button 81 is depressed to complete the binding operation.

When one or more sheet materials 2 are to be added to the already bound sheet materials 2, or all or part of the bound sheet materials are to be exchanged with another set of sheet materials, the bound sheet materials are set so that the sheet materials 2 are below the upper supporting member 52 as shown in FIG. 16, and the ring opening and closing operations and the sheet punching operations are carried out in the manner described in the foregoing means, by which the sheet materials 2 are added in the interchange.

In this embodiment, at one longitudinal end of the resin ring 6, the pawl 6A and the spine 6B are flush, but it is a possible alternative that the extension of a reference side end of the spine 6B of the resin ring 6 is made different from that at the opposite end so that it is smaller than the reference side, and that the stopping member 71 on the upper supporting member 52 of the binding means R is matched with the shorter extension. By doing so the same advantageous effects can be provided.

As described in the foregoing according to the fifth embodiment, the longitudinal end extensions of the spine of the resin ring beyond the outermost pawls are made different, and a limiting member is provided on the binding means at a position corresponding to one of the longitudinal extensions, and therefore, the erroneous orientation of the resin ring can be prevented, and therefore, improper binding operation is prevented beforehand.

An apparatus of sixth embodiment will be described which is similar to the apparatus described in conjunction with FIGS. 1–16, but in which the detecting means is retractable out of the conveying passage.

In this embodiment, when the lower supporting member 56 is lowered, a sensor supporting plate 83 on which the ring sensor lever 60 and the ring sensors 61*a* and 61*b* are mounted is lowered. Therefore, the ring sensor lever 60 projected into the sheet material conveying passage is retracted therefrom. Therefore, the ring sensor lever 60 does not interfere with the sheet materials 2 being conveyed, so that the binding operations are stabilized.

In this embodiment, together with the lowering of the lower supporting member 56 of the binding means, the sensor supporting plate 83 on which the ring sensor lever 60 and the ring sensors 61*a* and 61*b* are mounted is lowered to be retracted from the sheet conveying passage. However, it is a possible alternative that the ring sensor lever 60 is retracted from the sheet conveyance passage by a solenoid operable independently from the operation of the lower supporting member 56.

Figure 32A:
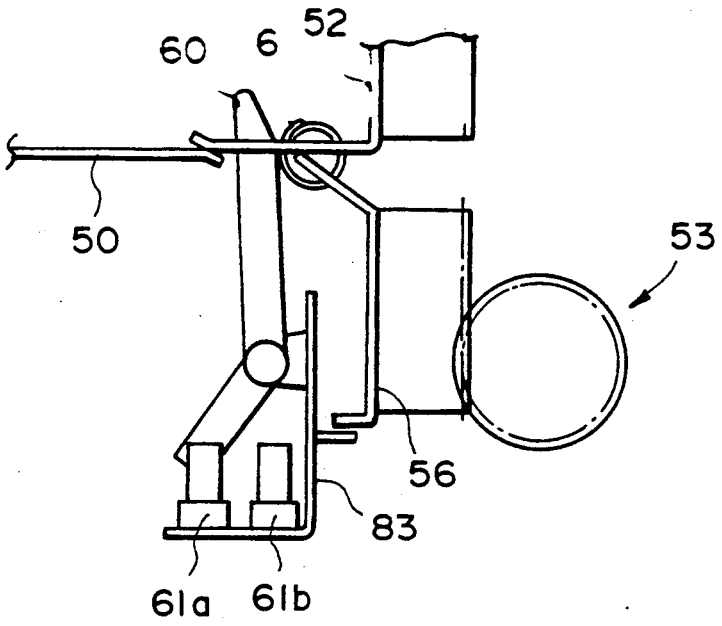
FIGS. 32A and 32B are longitudinal sectional views of a ring sensor lever for a plastic resin ring according to a sixth embodiment of the present invention.
Figure 32B:
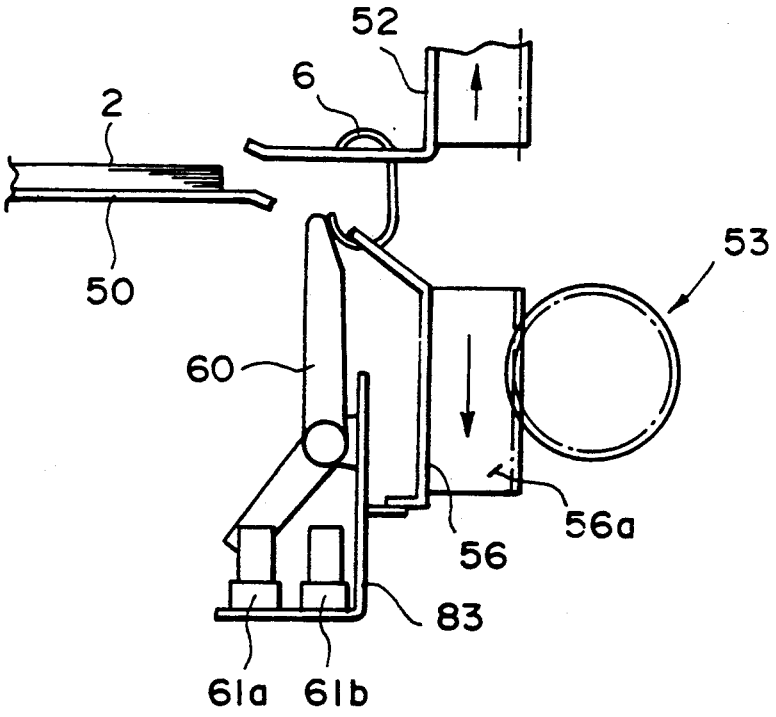

According to the sixth embodiment shown in FIG. 32, a sheet binding apparatus is provided which comprises punching means 3 for punching the sheet materials 2, conveying means 40*a* and 40*b* for conveying the sheet materials 2 punched by said punching means to a binding position, and binding means R for binding the sheet materials 2 conveyed by the conveying means with a plastic resin binding member 6, detecting means 60, 61*a* and 61*b* for detecting the resin binding member 6 in said binding means R, wherein after the resin binding member 6 is set in the binding means R, and the presence and the kind of the resin binding member 6 is detected by the detecting means 60, 61*a* and 61*b*, the detecting means 60, 61*a* and 61*b* are retracted from the conveying passage of the conveying means 40*a* and 40*b*. Accordingly, when the resin ring 6 is set in the binding means R, the detecting means 60, 61*a* and 61*b* are placed at their detecting positions, and when the sheet materials are conveyed to the binding means R, the detecting means 60, 61*a* and 61*b* are moved to a position retracted from the sheet material 2 passage so as not to interfere with the sheet materials 2 being conveyed to the binding means R.

Therefore, the ring sensor lever is retracted from the sheet material conveying passage after it detects the presence and/or the size of the resin ring, whereby it does not obstruct the conveyance of the sheet materials, so as to stabilize the binding operation.

An apparatus according to a seventh embodiment which is similar to the apparatus described in conjunction with FIGS. 1-16, but in which after the sheet materials are bound, the ring binding member is displaced to a position for easy retraction of the sheet materials.

Figure 33A:
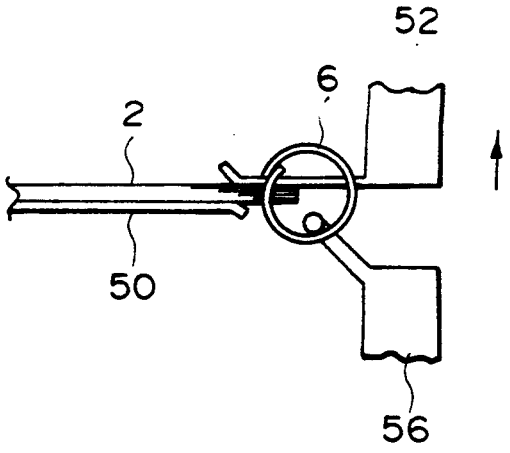
FIGS. 33A and 33B are side views of a sheet binder means of the apparatus according to a seventh embodiment of the present invention.
Figure 33B:
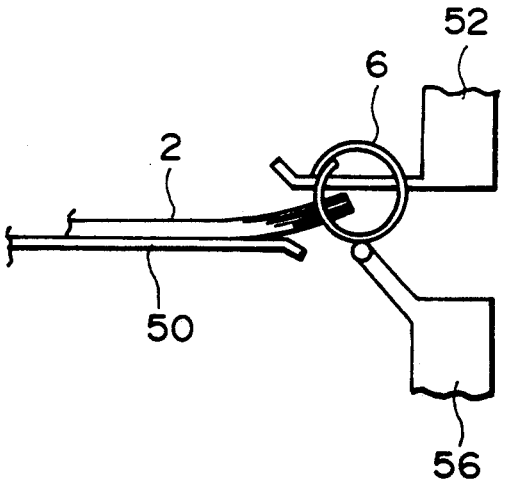

After the sheet materials 2 are bound, the resin ring (elastic binding member) 6 is closed, as shown in FIG. 33A. At this time, a substantial part of the resin ring 6 is below the conveying table 50, and it is supported only by the upper supporting member 60. When the operator pulls the sheet materials together with the resin ring 6 binding them, the resin ring 6 abuts the conveying table 50, and therefore, the sheet material retraction action is obstructed. In this embodiment, therefore, after the binding operation of the sheet material 2 is completed by closing the resin ring 6, the upper supporting member 52 is displaced or shifted in the direction indicated by an arrow in FIG. 33A. By the movement, the resin ring 6 supported on the upper supporting member 52 is displaced to a position above the conveying table 50, as shown in FIG. 33B. The movement is accomplished through the gear train 55. By this movement of the resin ring 6, the resin ring 6 does not interfere with the conveying table 50 when the sheet material 2 is pulled out of the apparatus, without damage to the sheet materials.

At this time, the limiting member 71 and the ring inlet limiting member 51 is rotatable along with the retraction of the sheet materials 2, and therefore, they do not interfere with the sheet retracting action.

As described in the foregoing, according to the seventh embodiment (FIG. 33), after the sheet material is bound by the binding means, the elastic binding member (elastic resin ring, for example) is shifted to a position out of interference with the conveying passage (conveying means), and therefore, the bound sheet materials can be easily taken out without damage thereto.

While the invention has been described with reference to the structures disclosed herein, it is not confined to the details set forth and this application and is intended to cover such modifications or changes as may come within the purposes of the improvements or the scope of the following claims.

What is claimed is:

1. A sheet binding apparatus, comprising:

supporting means for supporting a set of sheets;

punching means for punching the set of sheets on said supporting means;

binding means for supporting a ring member and for binding the sheets by penetrating the ring member through punched holes or the sheets punched by said punching means;

size signal generating means for generating a signal indicative of the size of the ring member supported on said binding means;

means for changing a punching condition by said punching means in accordance with an output of said size signal generating means; and conveying means for conveying the set of sheets punched by said punching means to the ring member supported on said binding means.

2. An apparatus according to claim 1, wherein said changing means includes stopping means for positioning the set of sheets and changing the positions at which the set of sheets is punched by said punching means.

3. An apparatus according to claim 1, wherein said binding means includes means for supporting the ring member in its closed state, for opening the ring member after said punching means punches the sheets and for closing the ring member after the sheets are conveyed thereto.

4. An apparatus according to claim 1, wherein said size signal generating means includes a member movable by being urged by an outer periphery of the ring member set on said binding means and means for detecting amount of movement of said movable member.

5. An apparatus according to claim 1, further comprising means for displaying an erroneous operation when the set of sheets is set in said punching means before the ring member is set in said binding means.

6. A sheet binding apparatus, comprising:

supporting means for supporting a set of sheets;

punching means for punching the set of sheets on said supporting means;

binding means for supporting a ring member and for binding the sheets by penetrating the ring member through punched holes of the sheets punched by said punching means;

size signal generating means for generating a signal indicative of a size of the ring member supported on said binding means;

means for changing a punching condition by said punching means in accordance with an output of said size signal generating means;

conveying means for conveying the set of sheets punched by said punching means to the ring member supported on said binding means;

supporting means for supporting said binding means for movement between an automatic mode position wherein said binding means receives the set of sheets conveyed by said conveying means and a manual mode position wherein the set of sheets can be received without the use of said conveying means; and detecting means for detecting the manual mode position of said binding means to prohibit conveying operation of said conveying means.

7. An apparatus according to claim 6, further comprising control means for controlling said binding means in the manual mode.

8. An apparatus according to claim 7, wherein said control means includes means for determining a degree of opening of the ring member.

9. An apparatus according to claim 7, wherein said control means includes ring manipulating means for opening and closing the ring member.

10. An apparatus according to claim 1, further comprising control means for controlling the degree of opening of the ring member, said control means being responsive to said size signal generating means.

11. An apparatus according to claim 6, further comprising means for measuring the time period in which the ring member is kept opened, and means for controlling said binding means to close the ring member when an output of said measuring means indicates that the ring member is kept opened for a period longer than a predetermined period.

* * * * *

UNITED STATES PATENT AND TRADEMARK OFFICE

CERTIFICATE OF CORRECTION

PATENT NO. : 5,090,860

DATED : February 25, 1992

INVENTOR(S) : Kazuhiro Matsuo, et al.

It is certified that error appears in the above-identified patent and that said Letters Patent is hereby corrected as shown below:

Title page, item

[30] FOREIGN APPLICATION PRIORITY DATA:

"1-36844" should read --1-136844--.

Title page, item

[73] ASSIGNEE:

"Assignee: Canon Kabushiki Kaisha, Tokyo, Japan" should read --Assignees: Canon Kabushiki Kaisha, Tokyo; Daiichi Seiki Kogyo Kabushiki Kaisha, Mitsukaido, both of Japan--.

Drawings:

SHEET 16:

Figure 19, "STOPPES" should read --STOPPERS--.

SHEET 18:

Figure 21, "PREDTERM" should read --PREDETERMINE--.

COLUMN 3:

Line 54, "it is" should read --they are--.
Line 55, "it is" should read --they are--.
Line 56, "holes 12a" should read --holes 10a--.
Line 59, "lowers" should read --is lowered--.
Line 67, "punching" should read --pushing--.

UNITED STATES PATENT AND TRADEMARK OFFICE

CERTIFICATE OF CORRECTION

PATENT NO. : 5,090,860

DATED : February 25, 1992

INVENTOR(S) : Kazuhiro Matsuo, et al.

It is certified that error appears in the above-identified patent and that said Letters Patent is hereby corrected as shown below:

COLUMN 4:

Line 1, "plate 25." should read --plate 26.--.
Line 7, "punches 17," should read --puncher 17,--.
Line 9, "at" should read --with--.
Line 13, "punches 17" should read --punchers 17--.
Line 25, "arm 26" should read --arm 29--.
Line 48, "roller 41a." should read --roller 40a.--.
Line 50, "41b." should read --40b.--.

COLUMN 5:

Line 4, "sensor 49" should read --sensor 39--.
Line 44, "pawl 56" should read --pawls 56--.

COLUMN 6:

Line 27, "punches 17" should read --punchers 17--.
Line 32, "presses" should read --press--.
Line 44, "punches 17" should read --punchers 17--.
Line 59, "punches 17" should read --punchers 17--.
Line 62, "punches 17" should read --punchers 17--.

COLUMN 7:

Line 14, "stop produces" should read --stops producing--.

UNITED STATES PATENT AND TRADEMARK OFFICE

CERTIFICATE OF CORRECTION

PATENT NO. : 5,090,860

DATED : February 25, 1992

INVENTOR(S) : Kazuhiro Matsuo, et al.

It is certified that error appears in the above-identified patent and that said Letters Patent is hereby corrected as shown below:

COLUMN 8:

Line 29, "materials 6" should read --materials 2--.

COLUMN 9:

Line 25, "ring 8" should read --ring 6--.

COLUMN 11:

Line 5, "punches 17" should read --punchers 17--.
Line 27, "punches 17" should read --punchers 17--.
Line 30, "punches 17" should read --punchers 17--.
Line 35, "pressing" should read --confining--.
Line 47, "link 6" should read --ring 16--.
Line 60, "guide 46" should read --guide 49--.
Line 67, "punches 17" should read --punchers 17--.

COLUMN 12:

Line 2, "punches 17" should read --punchers 17--.
Line 4, "punches 17" should read --punchers 17--.
Line 5, "punches" should read --punchers--.
Line 10, "punches 17" should read --punchers 17--.
Line 17, "prevent," should read --prevent-- and "adver-" should read --inadver- --.
Line 29, "added" should read --supplied--.
Line 68, "punches 17 ar" should read --punchers 17 are--.

UNITED STATES PATENT AND TRADEMARK OFFICE

CERTIFICATE OF CORRECTION

PATENT NO. : 5,090,860

DATED : February 25, 1992

INVENTOR(S) : Kazuhiro Matsuo, et al.

It is certified that error appears in the above-identified patent and that said Letters Patent is hereby corrected as shown below:

COLUMN 13:

Line 5, "presses" should read --press--.
Line 19, "punches 17" should read --punchers 17--.
Line 22, "punches 17" should read --punchers 17--.
Line 42, "stop produces" should read --stops producing--.

COLUMN 14:

Line 21, "opened" should read --open--.
Line 34, "opened" should read --open--.
Line 49, "description" should read --descriptions--.
Line 55, "operation" should read --operations--.

COLUMN 15:

Line 14, "punches 17" should read --punchers 17--.
Line 58, "gap X" should read --gap x--.

COLUMN 16:

Line 28, "the stopper are" should read --stoppers is--.
Line 31, "punches 17" should read --punchers 17--.
Line 45, "punches 17" should read --punchers 17--.
Line 66, "lever 40," should read --lever 41,--.

COLUMN 17:

Line 2, "punches 17" should read --punchers 17--.

UNITED STATES PATENT AND TRADEMARK OFFICE

CERTIFICATE OF CORRECTION

PATENT NO. : 5,090,860

DATED : February 25, 1992

INVENTOR(S) : Kazuhiro Matsuo, et al.

It is certified that error appears in the above-identified patent and that said Letters Patent is hereby corrected as shown below:

Line 4, "punches 17" should read --punchers 17--.
Line 5, "punches 17" should read --punchers 17--.
Line 18, "punches 17" should read --punchers 17--.
Line 20, "punches 17" should read --punchers 17--.
Line 39, "an" should read --and--.
Line 58, "a" should read --as--.
Line 63, "spine 6B" should read --spine 6b--.
Line 64, "6A." should read --6a.-- and "pawl 6A" should read --pawl 6a--.
Line 65, "6B" should read --6b--.

COLUMN 18:

Line 29, "reaches" should read --reach--.
Line 41, "position" should read --positions--.
Line 48, "continued" should read --continues--.

COLUMN 19:

Line 34, "pawls 6A," should read --pawls 6a,--.
Line 46, "several" should read --when several--.
Line 68, "pawl 6A an the spine 6B" should read --pawl 6a and the spine 6b--.

COLUMN 20:

Line 2, "spine 6B" should read --spine 6b--, and "ring 6" should read --ring 6B--.

UNITED STATES PATENT AND TRADEMARK OFFICE

CERTIFICATE OF CORRECTION

PATENT NO. : 5,090,860 Page 6 of 6

DATED : February 25, 1992

INVENTOR(S) : Kazuhiro Matsuo, et al.

It is certified that error appears in the above-identified patent and that said Letters Patent is hereby corrected as shown below:

COLUMN 21:

Line 1, "An" should read --In an--.
Line 10, "member 60." should read --member 52.--.
Line 28, "is" should read --are--.
Line 41, "and" (first occurrence) should read --in--.
Line 52, "or" should read --of--.

Signed and Sealed this

Eleventh Day of January, 1994

*Attest:*

Bruce Lehman

BRUCE LEHMAN

*Attesting Officer*

*Commissioner of Patents and Trademarks*